US005666685A

United States Patent [19]

von Grolman et al.

[11] Patent Number: 5,666,685

[45] Date of Patent: Sep. 16, 1997

[54] HAND-HELD IMPLEMENT FOR CLEANING SMOOTH SURFACES

[75] Inventors: Tassilo von Grolman, Oberursel; Bernhard Heise, Friedberg; Uwe Dingert, Abtsteinach, all of Germany

[73] Assignee: Vileda GmbH, Weinheim, Germany

[21] Appl. No.: 612,898

[22] PCT Filed: Sep. 7, 1994

[86] PCT No.: PCT/EP94/02984

§ 371 Date: Mar. 5, 1996

§ 102(e) Date: Mar. 5, 1996

[87] PCT Pub. No.: WO95/07044

PCT Pub. Date: Mar. 16, 1995

[30] Foreign Application Priority Data

Sep. 7, 1993 [DE] Germany ..... 43 30 271.8

[51] Int. Cl.[6] ..... A47L 1/06

[52] U.S. Cl. ..... 15/121; 15/220.1; 15/245

[58] Field of Search ..... 151/121, 181, 151/117, 114, 111, 143.1, 245, 220.1; 7/167, 170

[56] References Cited

U.S. PATENT DOCUMENTS

| | | | |
|---|---|---|---|
| D. 213,721 | 4/1969 | Lorenz, Jr. | D49/21 |
| D. 279,932 | 7/1985 | Bergström | D32/41 |
| D. 296,946 | 7/1988 | Stirling | D32/41 |
| D. 307,963 | 5/1990 | Newman, Sr. et al. | D32/41 |
| D. 343,265 | 1/1994 | Pollak et al. | D32/41 |
| D. 366,739 | 1/1996 | von Grolman et al. | D32/42 |
| 947,145 | 1/1910 | Ax | 15/245 |
| 948,641 | 2/1910 | Bailey | 15/245 |
| 1,655,085 | 1/1928 | Beveridge et al. | 15/117 |
| 1,690,581 | 11/1928 | Hoff | 15/121 |
| 1,761,180 | 6/1930 | Cave et al. | 15/117 |
| 1,778,121 | 10/1930 | Paull . | |
| 2,278,208 | 3/1942 | Minnis | 15/245 |
| 2,663,889 | 12/1953 | Fuglie | 15/121 |
| 2,842,789 | 7/1958 | Wells | 15/121 |
| 2,936,469 | 5/1960 | Eklind | 15/121 |
| 3,110,052 | 11/1963 | Whitman | 15/117 |
| 3,457,579 | 7/1969 | Shea | 15/121 |
| 4,312,093 | 1/1982 | Raab | 15/121 |
| 4,430,769 | 2/1984 | Bergström | 15/245 |
| 4,455,705 | 6/1984 | Graham | 15/121 |
| 5,083,338 | 1/1992 | Unger | 15/121 |

FOREIGN PATENT DOCUMENTS

| | | | |
|---|---|---|---|
| 74525 | 3/1983 | European Pat. Off. | 15/121 |
| 2844185 | 6/1979 | Germany . | |
| 9309410.8 | 9/1993 | Germany . | |
| WO93/0872 | 5/1993 | WIPO . | |

*Primary Examiner*—Tony G. Soohoo

*Attorney, Agent, or Firm*—Dressler, Rockey, Milnamow & Katz, Ltd.

[57] ABSTRACT

The invention relates to a hand-held unit (200) for cleaning smooth surfaces and for squeegeeing liquid. The hand-held unit is made up of a cleaning unit (230) with a handle (234) and a wiper plate (238) as well as of a squeegeeing unit (232) with a rear stop (252) of the squeegeeing unit (232). A handle (236) of the squeegeeing unit (232) can be pushed telescopically into a tubular handle (234) of the cleaning unit (230) until a stop edge (252) of the squeegeeing unit strikes against a front stop edge (242) of the wiper plate (238). The two units (230, 232) can be held, by at least one latching and/or frictionally locking connection, in the position in which they are pushed one inside the other to provide the hand-held unit (200), and can be released from one another by hand. Consequently, for the connection of the two units (230, 232), there is no need for any additional shaping or parts which obstruct the combined or separate handling of the units.

44 Claims, 15 Drawing Sheets

HAND-HELD IMPLEMENT FOR CLEANING SMOOTH SURFACES

BACKGROUND OF THE INVENTION

The invention relates to a hand-held implement for cleaning smooth surfaces and for removing with a squeegee member washing liquid from such surfaces in accordance with the preamble of Patent Claim 1.

Hand-held implements of this generic type are known from U.S. Pat. No. 3,110,052, U.S. Pat. No. 5,083,338, or International ("P.C.T") Patent Application Publication No. WO 93/8725. They make it possible to clean and dry smooth surfaces in one operation, because the cleaning member and the squeegee member are arranged at the front end of the hand-held implement. The cleaning member and the squeegee member frequently comprise a cleaning pad and a squeegee. The cleaning pad serves, inter alia, for absorbing the washing liquid when the latter is squeegeed downwards on the smooth surface in order as far as possible to avoid soiling of surfaces which bound the smooth surface at the bottom end, e.g. a window frame. The known hand-held implements may be equipped with a handle in order that the user can also reach and clean more remote spots on the surface which is to be cleaned.

SUMMARY OF THE INVENTION

The object of the invention is to improve a hand-held implement of said known generic type in order to provide a hand-held implement which is extremely compact, streamlined, can be handled optimally during use, and in the case of which the cleaning member and the squeegee member are arranged one behind the other at one end of the hand-held implement and can be used together, but also separately from one another as an independent unit in each case, the means for the releasable connection of the cleaning unit and squeegee unit being barely visible, or not visible at all, and not having an adverse effect on the handling of the units. In this arrangement, said virtually invisible connecting means are to permit secure connection of the two units, but, nevertheless, are to ensure that the two units can be separated easily by hand.

The invention achieves this object by the features in the characterizing part of Patent Claim 1.

Since the cleaning member and the squeegee member are arranged directly behind one another at the same end, as is the case for the non-dismantleable units of said known generic type, the hand-held instrument permits approximately simultaneous washing-down and squeegeeing of surfaces which are to be cleaned. It is likewise possible to separate the two units by hand in a simple manner, with the result that, if required, the cleaning unit and squeegee unit can be used simultaneously, but independently of one another, e.g. even by two people.

According to a first embodiment of the hand-held implement of the invention, the squeegee unit is inserted, by means of a lateral engagement part, in the lateral receiving part until a front squeegee mount for a squeegee-lip-retaining guide rail of the squeegee unit strikes against a front edge of the wiper plate of the cleaning unit. The two units are then connected to one another in a releasable manner by the insertion of a locking cone into ends of the handles, located coaxially one inside the other, of the two units, these ends being located coaxially one behind the other and forming a common, conical locking opening towards the inside. This creates a connection between the two units which is positively locking in the axial direction of the hand-held implement and is secured by the locking cone in the direction transverse with respect to the longitudinal axis of the hand-held implement.

In the case of a second embodiment of the hand-held implement according to the invention, the handle of the squeegeeing unit is pushed with a sliding fit into a front plug-in opening of the hollow handle of the cleaning unit until its front squeegee mount strikes against the front edge of the wiper plate of said cleaning unit, and the handle of the squeegee unit, in its end position, is connected in a releasable manner to that of the cleaning unit by a latching device which is provided between the two handles.

In the case of a third embodiment of the handle-held implement according to the invention, a latching device is once again provided between the hollow handles of the two units. In this arrangement, the inner end of a conical opening in the handle of the cleaning unit bounds the push-in path for the handle of the squeegee unit.

In the case of a fourth embodiment of the hand-held implement according to the invention, the handle of the squeegee unit is once again pushed in telescopically until the squeegee mount of the same strikes against the washer plate, in which case, in the push-in end position of the squeegee unit, the releasable connection of the latter to the cleaning unit is provided by at least one latching device and/or at least one frictionally locking connection. In this arrangement, the latching device can be formed by latching lugs on the front edge of the washer plate of the cleaning unit, latching recesses in the squeegee mount of the squeegee unit corresponding to said latching lugs. The frictionally locking connection may comprise a clamping groove/clamping tongue connection between the cleaning head and the squeegee head of the two units.

Furthermore, a frictionally locking connection may be provided between the squeegee head of the cleaning unit and the cleaning head of the cleaning unit, in the case of which the upper side of the cleaning head forms a wedge-action run-on surface for the underside of the squeegee head, by means of which the squeegee head is raised slightly, before the squeegee unit reaches the push-in end position in the cleaning unit, in order that the upper side of the handle of the squeegee unit is pressed with frictional locking against the upper side of the inner wall in the front end of the handle of the cleaning unit, it being possible to release said frictional locking by hand.

The invention further embodies advantageously the features in the subclaims.

BRIEF DESCRIPTION OF THE DRAWING

The invention is explained in more detail hereinbelow with reference to the schematic drawing of a number of exemplary embodiments of a hand-held implement, in which drawing.

DESCRIPTION OF THE PREFERRED EMBODIMENTS

Figure 1:
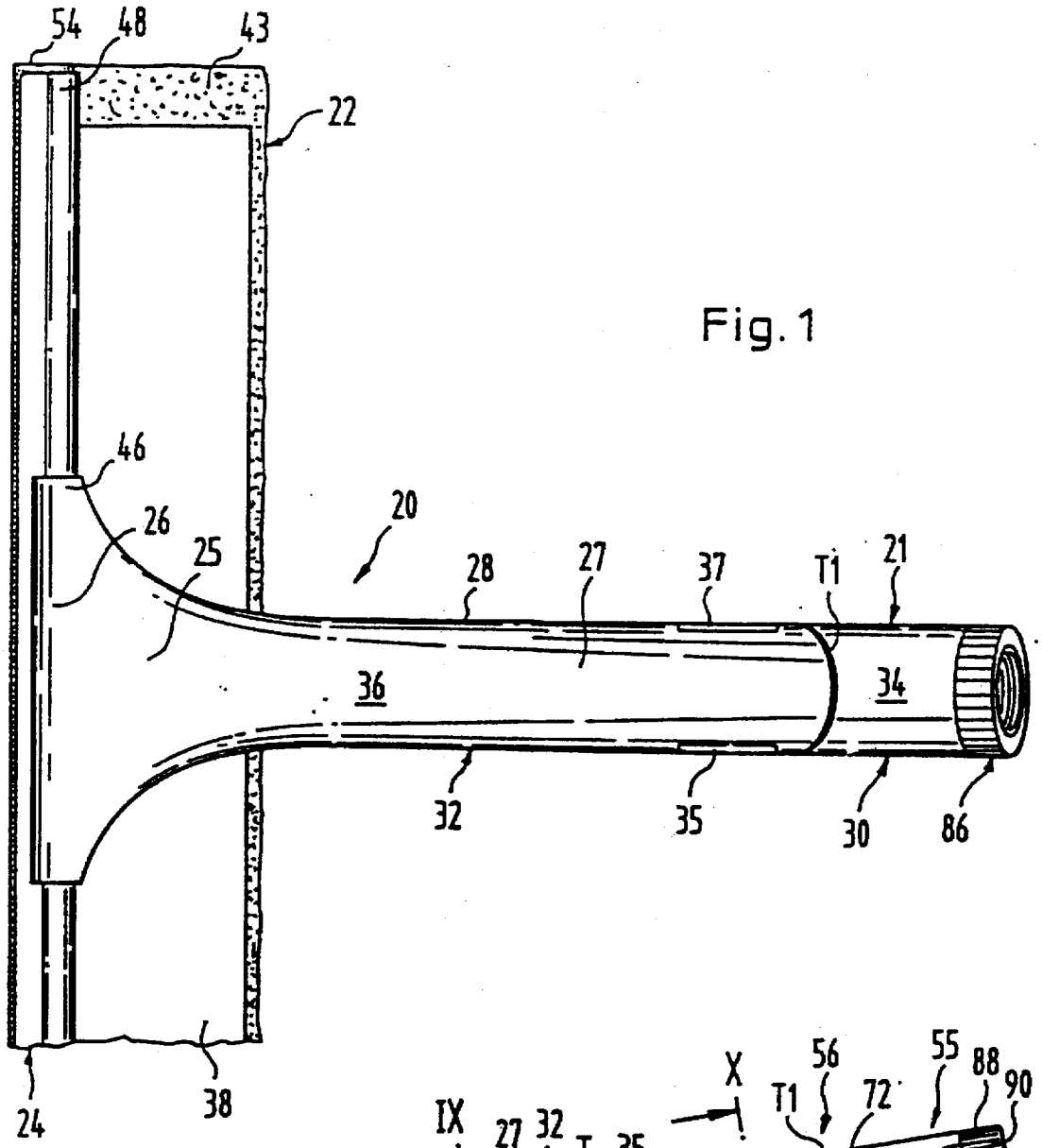
FIG. 1 shows a first embodiment of a hand-held implement in a partially broken-away plan view, a cleaning unit and a squeegee unit being connected to one another in a releasable manner.

Represented in the figures are various embodiments of the hand-held implement which serves to clean smooth surfaces and to squeegee liquid from said surfaces. A cleaning member and a squeegee member for liquid are arranged at the front end of the handle. According to the invention, the cleaning member is assigned to a cleaning unit, which is provided with a handle, and the squeegee member is assigned to a squeegee unit, which likewise exhibits a handle. The cleaning unit and the squeegee unit can be used independently of one another, but can also be connected to one another in a releasable manner to produce the hand-held implement, such that said hand-held implement can be used to clean or wash down surfaces and to squeegee the liquid, in particular, washing or cleaning liquid, approximately simultaneously, or else, once the connection between the cleaning unit and the squeegee unit has been released, each of said two units can be used alone.

A first embodiment of such a hand-held implement 20 is shown in FIGS. 1 to 10. According to FIGS. 1 and 2, a cleaning member 22 and a squeegee member 24 for liquid are arranged horizontally at the front end 26 of a handle 28, transversely with respect to the longitudinal axis thereof. The cleaning member 22 is assigned to a cleaning unit 30, which is produced from plastic, and the squeegee member 24 is assigned to a squeegeeing unit 32, which likewise consists of plastic, it being possible to use said two units when they have been connected to one another in a releasable manner and thus also when they are separate. Extending between the cleaning unit 30, which is at the bottom in FIG. 2, and the squeegee unit 32, which is arranged thereabove, is a curved parting plane T which runs essentially horizontally some way above a center longitudinal axis of the hand-held implement 20 and in which mutually corresponding parts of the cleaning unit 30 and of the squeegee unit 32 lie against one another or engage one inside the other when said units are in the assembled state, with the result that, when they have been assembled to form the hand-held implement 20 in FIGS. 1 and 2, the two units 30, 32 are blocked in an essentially positively locking manner both in the longitudinal direction and transversely with respect to the longitudinal direction of the hand-held implement 20 and are connected to one another in a releasable manner at the rear end of the handle 28 by means of a locking device 55 in FIG. 2.

Figure 2:
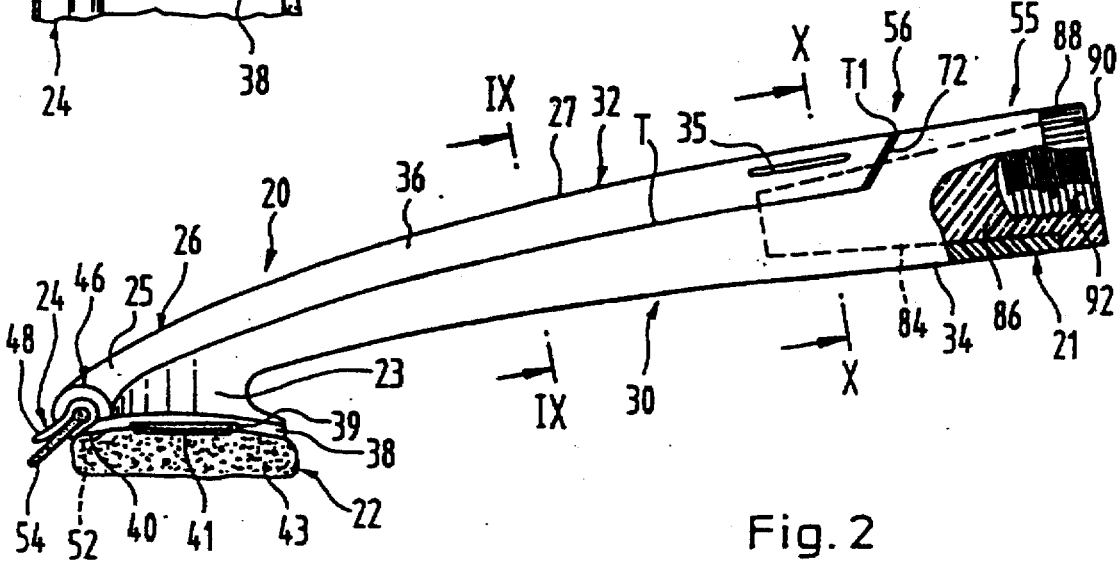
FIG. 2 shows a side view of the hand-held implement according to FIG. 1, in a partially broken-away representation.
Figure 3:
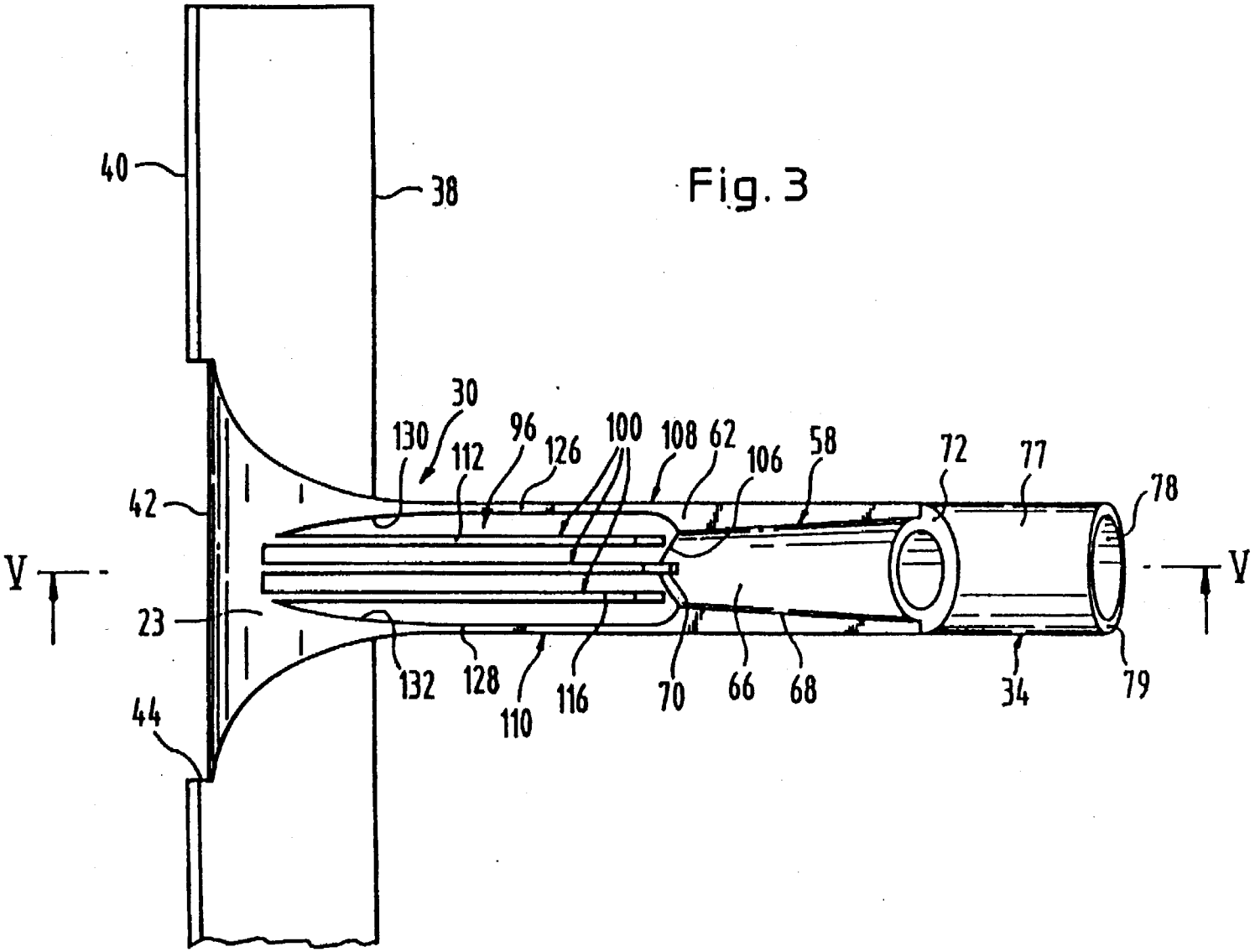
FIG. 3 shows a plan view of the cleaning unit of the hand-held implement according to FIGS. 1 and 2, the cleaning unit having been separated from the squeegee unit.

It can further be seen from FIGS. 1 and 2 that, in front of a rear end 21 of the handle 28, the parting plane T is cut, at T1, downwards and forwards into the handle 28 from the smooth upper side 27 of the hand-held implement 20. The parting plane T then runs horizontally, at an obtuse angle with respect to the incision T1, in the transverse direction of the handle, but forwards and slightly obliquely downwards in longitudinal direction of the handle 28, corresponding to the main axis thereof. In this arrangement, the parting plane T separates a bottom handle 34 and a front cleaning head 23 of the cleaning unit 30 from a handle 36, which is located thereabove, and a squeegee head 25 of the squeegee unit 32 and terminates in a stop edge 42, directed transversely with respect to the longitudinal direction of the hand-held implement 20, of the cleaning head 23 (FIG. 3). Said stop edge 42 of the cleaning head 23 rests against a cross-sectionally hook-like stop strip 52, which is drawn back in the rearwards direction, of the squeegee head 25 (FIGS. 2 and 6), with the result that the two units 30, 32 are closely connected to one another at the front. Said stop strip 52 is provided integrally on the underside of a tubular squeegee mount 46 for the squeegee member 24, which mount forms a front end of the squeegee head 25, in the transverse direction of the hand-held implement 20, and extends over the width of said head. However, if desired, the squeegee mount 46 may also extend fully beyond the two sides of the squeegee head 25. The handle 36 of the squeegee unit 32 is provided, on the two mutually opposite sides of its rear end, with laterally projecting webs 35, 37, which make it easier to separate the two units 30, 32.

According to FIGS. 1, 2, 3 and 5, the carrier for the cleaning member 22 comprises a wiper plate 38 which, as an integral constituent part of the front end of the handle 34 of the cleaning unit 30, which handle is smooth on the underside, is fastened horizontally and transversely with respect to the longitudinal direction of said cleaning unit and the front edge 40 of which is designed at least partially as the stop edge 42 (FIG. 3). The stop edge 42 of the wiper plate 38 is formed by a right-angled cutout 44 in the front edge 40 of the wiper plate 38 and is, accordingly, set back with respect to the front edge 40, parallel to the same. The cutout 44 is provided midway along the width of the wiper plate 38. If appropriate, however, a plurality of cutouts 44 may also be provided in order to form a plurality of stop edges 42 which are distributed over the width of the wiper plate 38 and to which a corresponding number of hook-shaped stop strips 52 on the squeegee head 25 are assigned.

According to FIG. 2, the wiper plate 38 has, on its underside, a flat, wide transverse groove 39 in which a touch-and-close fastener strip 41 may be arranged, for example by the use of bonding or screwing, it being possible for a cleaning pad 43 to be fastened on the underside of said fastener strip such that it can be exchanged. However, fastening means other than the touch-and-close fastener strip, for example a rail with press fasteners or the like, may also be considered. The cleaning pad 43 may consist of a pile fabric which is sewn around a foam core. However, the cleaning pad may also comprise cores with different combinations of polyurethane/viscose or the like encased by pile fabric, nonwovens, etc. The shaping of the foam core gives an improved bearing surface on the surface which is to be cleaned. Moreover, the foam core stores liquid, with the result that it is possible to clean large surface areas. In addition, it is also possible to provide other cleaning pads, e.g. viscose sponges. The simple fastening ensures easy exchange of the cleaning pad.

Figure 4:
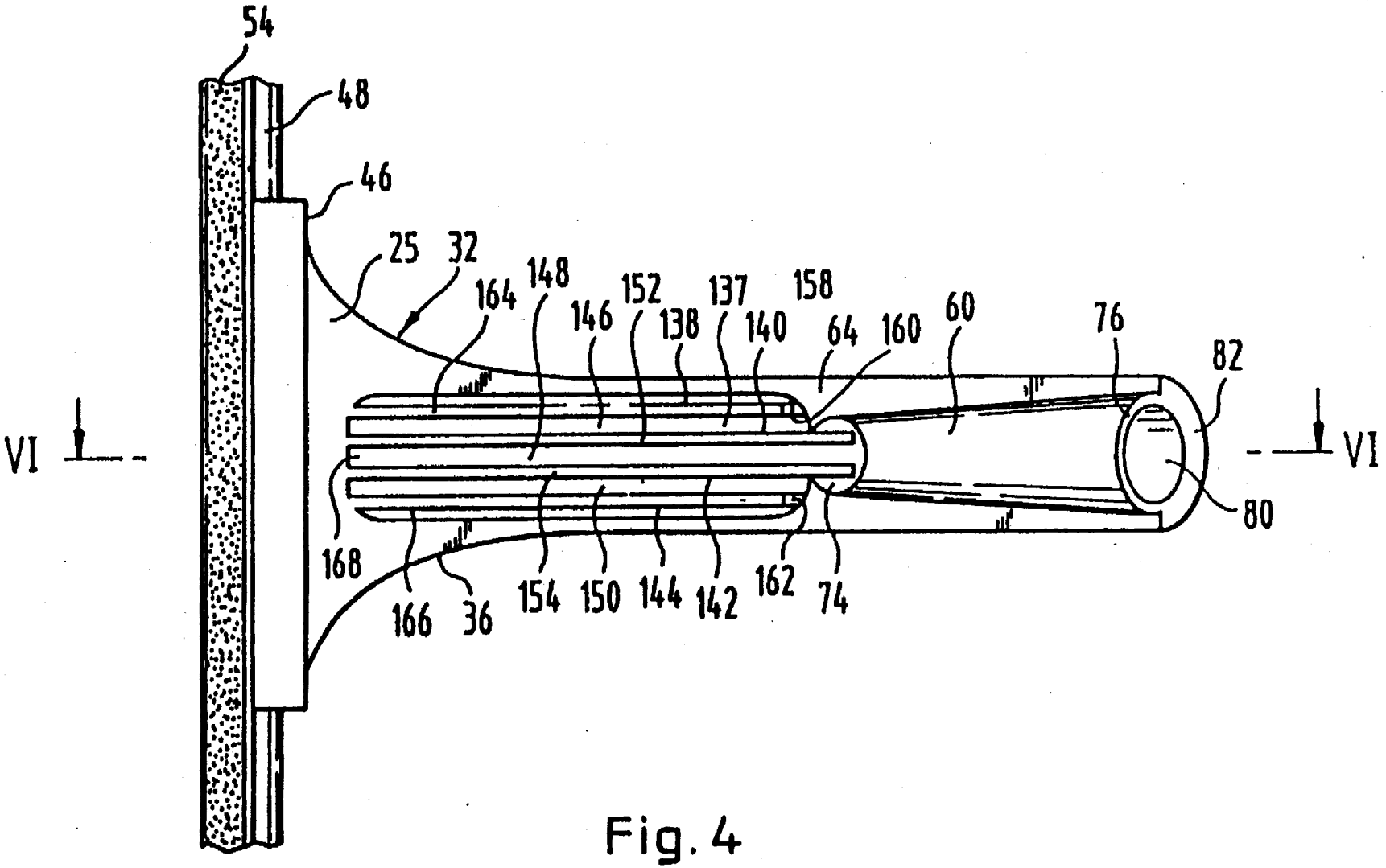
FIG. 4 shows a bottom view of the squeegee unit of the hand-held implement according to FIGS. 1 and 2, the squeegee unit having been separated from the cleaning unit.
Figure 6:
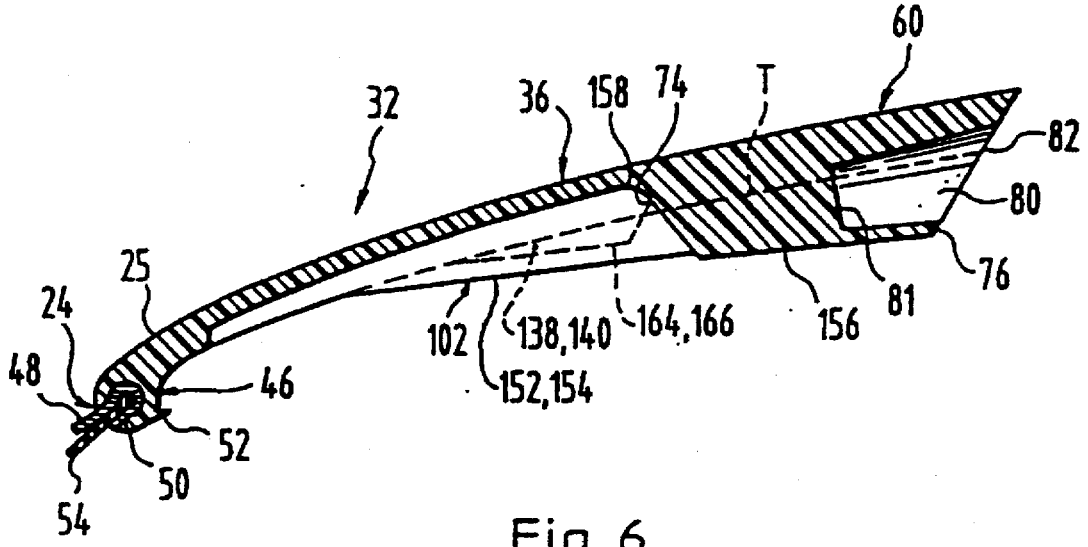
FIG. 6 shows a center longitudinal section VI—VI of the squeegee unit in FIG. 4.

According to FIGS. 2, 4 and 6, the tubular, cross-sectionally horseshoe-shaped squeegee mount 46 forms the carrier for the squeegee member 24. The squeegee mount 46 is provided, along a surface line, with the at least one stop strip 52 for the stop edge 42 of the wiper plate 38 of the cleaning unit 30 in FIG. 3. As has been mentioned, the stop strip 52 is directed obliquely downwards and towards the rear end of the cleaning unit 30 in a cross-sectionally hook-shaped manner, with the result that surface of the stop strip 52 which faces the rear end of the hand-held implement 20 forms an abutment for the stop edge 42 of the wiper plate 38 of the cleaning unit 30 when the cleaning unit 30 and squeegee unit 32 are combined to produce the hand-held implement 20.

According to FIG. 6, the opening of the cross-sectionally horseshoe-shaped profile of the squeegee mount 46 is formed by a longitudinal slit 50, which is directed obliquely forwards and downwards. A guide rail 48, which has a clamp-like profile and consists of metal or plastic, is pushed into the tubular squeegee mount 46, the guide rail being retained in a frictionally locking manner, such that it can be exchanged, by latching tabs (not shown) or by adhesive bonding. The guide rail 48 engages around a significant part of the upper side and the rear edge, and a smaller part of the underside, of a squeegeeing lip 54 which is made of elastic material, preferably rubber or plastic, and may have a transverse profile which is adapted to the guide rail 48. The squeegeeing lip 54 serves in the known manner for squeegeeing cleaning or washing liquid from a smooth surface of any objects, such as window panes, facades, etc., which is to be cleaned.

Figure 10:
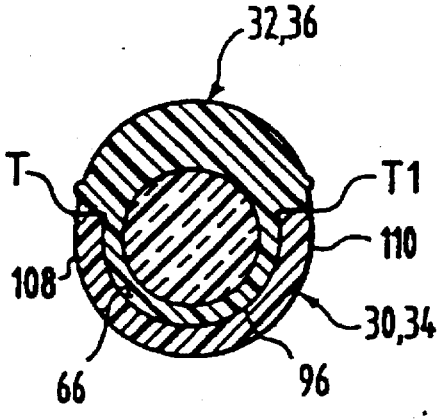
FIG. 10 shows a further cross-section X—X of the assembled hand-held implement in FIG. 2.

Furthermore, the connection between the handles 34, 36 of the cleaning unit 30 and of the squeegeeing unit 32 comprises a plug-in connection 56 (FIG. 2), by means of which the cleaning unit 30 and the squeegee unit 32 can be fixed in an essentially positively locking manner in the axial direction. According to FIG. 5, the plug-in connection 56 is made up of a lateral receiving part 58 in the handle 34 of the cleaning unit 30 and of a lateral engagement part 60 in the handle 36 of the squeegee unit 32 (FIGS. 3, 4, 5 and 6). The receiving part 58 in the handle 34 of the cleaning unit 30 and the engagement part 60 of the handle 36 of the squeegeeing unit 32 extend over part of the length of their associated handles 34, 36 and are each assigned to the rear half of the handle 34 or 36 of the cleaning unit 30 and of the squeegee unit 32, respectively. In the present exemplary embodiment, the receiving part 58 is provided in the upper side 62 of the cleaning unit 30, and the engagement part 60 is provided in an underside 64 of the squeegee unit 32 (FIGS. 3 and 4). The receiving part 58 in the upper side 62 of the cleaning unit 30 comprises a hollow 66 (FIGS. 3 and 5) which is U-shaped or semicircular in the cross-section of the handle 34 of the cleaning unit 30 (FIG. 10). Said hollow 66 of the receiving part 58 extends, in the longitudinal direction of the cleaning unit 30, over a length which is dimensioned to be greater than the width of the U-shaped hollow 66. Over its entire length, the U-shaped hollow 66 is tapered conically at a specific cone angle in the direction of the front end of the cleaning unit 30 at 68 (FIG. 3). The significance of the said conical tapering 68 is explained below.

Figure 5:
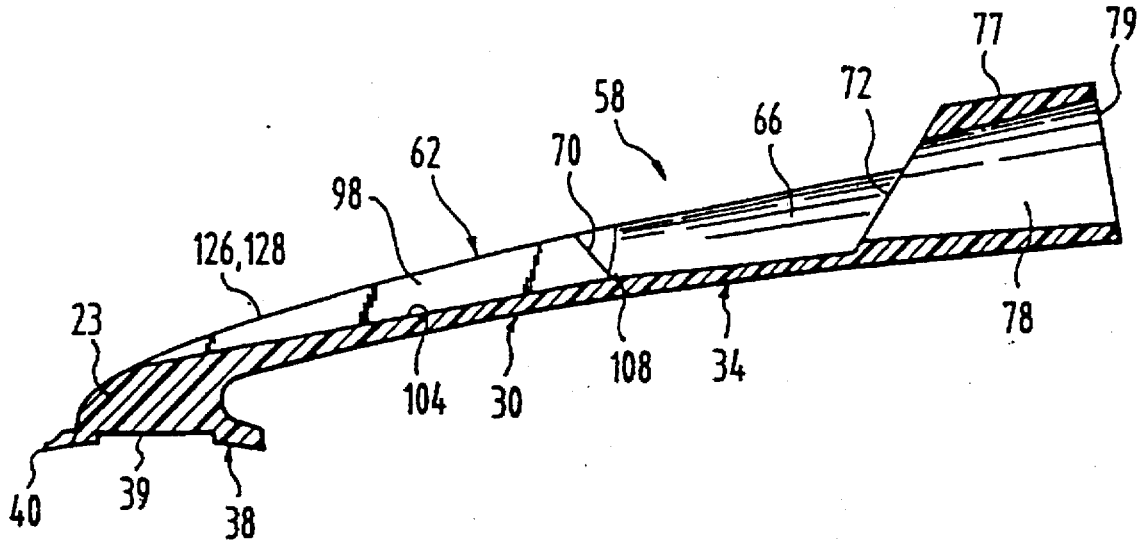
FIG. 5 shows a vertical center longitudinal section V—V of the cleaning unit in FIG. 3.

According to FIGS. 3 and 5, as seen in vertical center longitudinal direction, a front end side 70 of a securing device 100 and a rear end side 72 of a locking sleeve 77 of the cleaning unit 30 enclose an acute angle, which opens towards the upper side 62 of the cleaning unit 30, and at least partially bound the hollow 66 of the receiving part 58 of the cleaning unit 30. The front and rear end sides 70, 72 of the hollow 66 of the cleaning unit 30 each form a stop for a front and a rear end side 74, 76 of the engagement part 60 of the squeegee unit 32 (FIGS. 4 and 6).

As has been mentioned above, the cleaning unit 30 and the squeegee unit 32 form a constituent part of the locking device 55 (FIG. 2), by means of which the connection of the cleaning unit 30 and the squeegee unit 32 to one another to form the hand-held implement 20 represented in FIGS. 1 and 2 can be maintained. More precise details of said locking device 55 are explained herebelow.

According to FIG. 3, the rear end of the handle 34 of the cleaning unit 30 comprises a locking sleeve 77, which exhibits a through-opening 78 in the essentially axial direction. Said axial opening 78 is tapered conically towards the front and is bounded at the rear by an end 79 and at the front by the abovementioned end side 72 of the locking sleeve 77.

According to FIG. 6, the engagement part 60 is a conical body which, over its entire length, projects, with approximately two thirds of its cross-sectional dimension, beyond the underside 64 or parting plane T of the squeegee unit 32, but is produced integrally with the handle 36 of the latter. At its rear end side 76, the engagement part 60 exhibits an axial recess 80 (FIGS. 4, 6) which tapers conically towards the front and is closed off there by a base 81 (FIG. 6). The base 81 is arranged at a distance behind the front end side 74 of the engagement part 60. A rear opening 82 of the recess 80 is bounded by the rear end side 76 of the engagement part 60 and the handle 36 of the squeegeeing unit 32.

The cone angle of the axial opening 78 in the locking sleeve 77 and of the recess 80 in the engagement part 60 are approximately identical. Consequently, when the hand-held implement 20 is in the assembled state, the axial opening 78 in the locking sleeve 77 and the recess 80 in the engagement part 60 together form a locking opening 84 as constituent part of the locking device 65. Said locking opening 84 is indicated by dotted lines in FIG. 2 and serves to received a locking member as the second constituent part of the locking device 55. Said locking member comprises a locking bolt 86 which, in FIGS. 1 and 2, is inserted into said locking opening 84.

Figure 7:
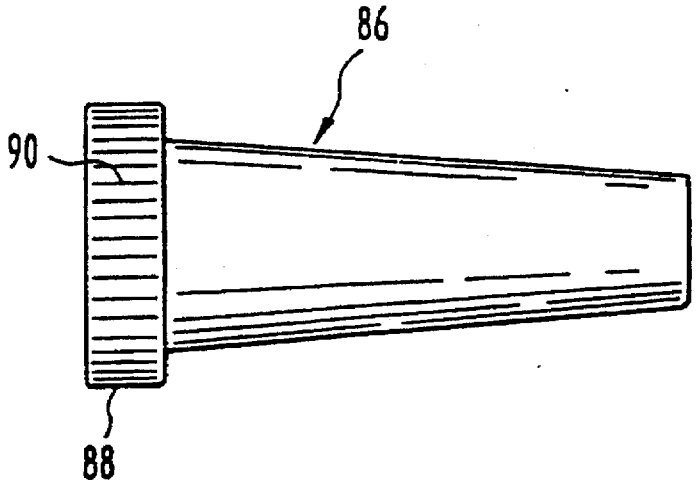
FIG. 7 shows a side view of a locking member.
Figure 8:
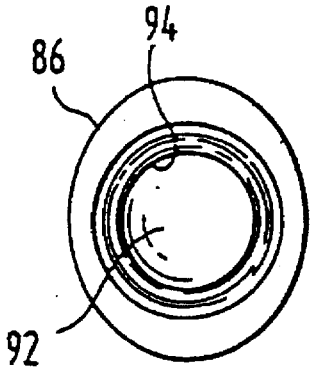
FIG. 8 shows an end view, from the left, of the locking member in FIG. 7.

According to FIGS. 2, 7 and 8, the locking bolt 86 is in a conical form, which approximately corresponds to the locking opening 84, and, at its rear end, it has a grip part 88 which has widened diameter and is roughened by hurling 90 or the like on the outside in order to improve the grip. Provided in the grip part 88 is a central plug-in opening 92, the wall of which is provided with an internal thread 94 into which an auxiliary device can be screwed. Said auxiliary device may comprise an extension shaft and/or a joint, each of which, if required, may be plugged or screwed into the plug-in opening 92 of the locking bolt 86. The locking bolt 86 and the locking opening 84 are of a slightly oval shape in cross-section or are provided with longitudinal ribs (not shown) in order to ensure that the locking bolt 86 is fitted in a fixed, but releasable manner in the locking opening 84. However, the locking bolt 86 may also be provided with a partially or wholly formed thread or annular beads or part of a bayonet closure or a conventional latching connection in order, when the cleaning unit and squeegee unit are attached, to engage or latch into a corresponding mating thread or into annular beads of the squeegee unit and cleaning unit.

Figure 9:
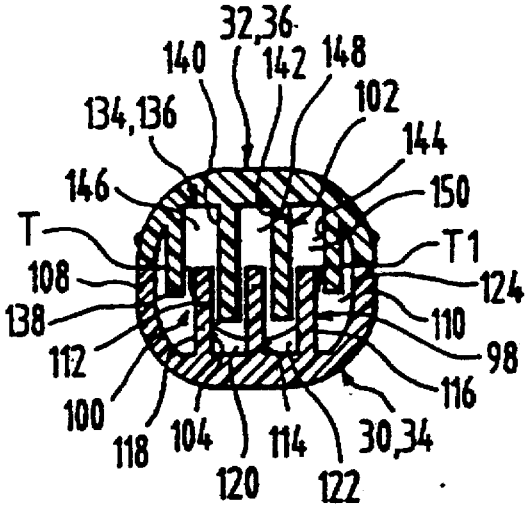
FIG. 9 shows a cross-section IX—IX of the assembled hand-held implement in FIG. 2.

According to FIG. 3, the handle 34 of the cleaning unit 30 has a dish-shaped depression 96 in front of its receiving part 58 and is provided with at least a first part 98 of the abovementioned securing device 100 (FIGS. 5 and 9). Said first part 98 of the securing device 100 interacts with a second part 102 of the securing device 100 on the squeegee unit 32 in order to prevent guidance between the squeegee unit 32 and cleaning unit 30. The securing device 100 comprises one or more groove/tongue connections, which are explained hereinbelow.

It can be seen, in particular, from FIGS. 3 to 6 and 9 that said groove/tongue connection is provided in a mutual arrangement between the handles 34, 36 of the cleaning unit 30 and squeegee unit 32. Thus, the upper side 62 of the front longitudinal half of the handle 34 of the cleaning unit 30 exhibits the dish-shaped depression 96 which, in the longitudinal direction of the cleaning unit 30, forms a U-shaped longitudinal groove 104 which extends forwards and upwards from a front end 106 of the receiving part 58 to the upper side of the cleaning head 23. The two legs of said U-shaped longitudinal groove 104 are formed by handle walls 108, 110. Three locking ribs 112, 114, 116 project vertically upwards from the base of said longitudinal groove 104, the ribs extending parallel to the longitudinal axis of the handle 34 and reinforcing the latter. Together with the handle walls 108, 110, the locking ribs 112, 114, 116 form four locking grooves 118, 120, 122, 124 of the same width. The height of the locking ribs 112, 114, 116 corresponds to that of the upper longitudinal edge 126, 128, curved upwards in a slightly arcuate manner, of the mutually opposite, longitudinally extending handle walls 108, 110. Since the U-shaped longitudinal groove 104 terminates on the upper side 27 of the cleaning head 23, the longitudinal groove 104 tapers in that the inner side 130, 132 of the handle walls 108, 110 intersect with the outer sides of the outer locking ribs 112 and 116 at the front end of the dish-shaped depression 96 (FIG. 3).

According to FIGS. 4 and 9, the mating piece for the front length section of the handle 34 of the cleaning unit 30 is formed by the underside 64 of the handle 36 of the squeegee unit 32. Said underside 64 of the squeegee unit 32 is provided with a hollowing 134 (FIGS. 6 and 9) in that length section of the handle 36 which is located in front of the engagement part 60. The hollowing 134, in turn, forms a longitudinal groove 136 with an upside-down U-profile, four locking ribs 138, 140, 142, 144 projecting vertically downwards, parallel to the longitudinal axis of the handle 36 and at a distance from one another, from the base 137 of said longitudinal groove 136 (FIG. 9). Said four locking ribs 138, 140, 142, 144 of the squeegee unit 32 serve to reinforce the squeegee handle 36 and form three locking grooves 146, 148, 150 of the same width, these grooves being dimensioned to be slightly larger than the width of the three locking ribs 112, 114, 116 of the cleaning unit 30. Consequently, the three locking ribs 112, 114, 116 of the cleaning unit 30 can engage into the three locking grooves 146, 148, 150 of the squeegee unit 32. At the same time, the four locking ribs 138, 140, 142, 144 of the squeegee unit 32 engage into the four locking grooves 118, 120, 122, 124 of the cleaning unit 30 when the two units 30, 32 are combined with one another, by plugging them laterally one inside the other, to form the compact hand-held implement 20. It can be seen that the above-described locking grooves and locking ribs reduce the outlay in terms of material, and thus the weight, for the two units 30, 32, but, at the same time, in addition to the above-mentioned handle reinforcement, ensure stable alignment and connection of the units 30, 32 over their entire length. Of course, the number of locking ribs and locking grooves may vary, for example depending on the selected overall dimensions of the hand-held implement 20. Furthermore, the shape of the interengaging elements of the two units 30, 32 may also be modified if appropriate.

According to FIGS. 4 and 6, the two central locking ribs 140, 142 of the squeegee unit 32 extend up to the front end side 74 of the engagement part 60. In this engagement, lower longitudinal edges 152, 154 of said two central locking ribs 140, 142 are arranged on a rear length section, corresponding approximately to three quarters of the length of said locking ribs 140, 142, essentially parallel to a bottom surface line 156 of the conical engagement part. 60 (FIG. 6), but are offset upwards as regards their level with respect to the bottom surface line 156 of the engagement part 60. The height of the locking ribs 140, 142 decreases more and more over the base of the upside-down U-shaped longitudinal groove 136 in the squeegee handle 36 until they reach the level of the underside 64, which defines the parting plane T, of the handle 36.

The two outer locking ribs 138 and 144 of the squeegeeing unit 32 are of shorter dimensions towards the rear and, at their rear end, only extend to a fillet 158 of the longitudinal groove 104 (FIG. 4), into which the front end side 74 emerges, as FIG. 6 shows, the rear end edges 160, 162 of said locking ribs being bevelled downwards and forwards. Lower longitudinal edges 164, 166 of said outer locking ribs 138, 144 run at a lower level than the lower longitudinal edges 152, 154 of the central pair of locking ribs 140, 142, but parallel thereto over a rear half of their length. At a correspondingly earlier stage, the two outer locking ribs 138, 144 are angled off to be level with the underside of the squeegee head 25 and terminate, as do the two central locking ribs 140, 142, in a front, filleted end surface 168 (FIG. 4) of the upside-down U-shaped longitudinal groove 104 [sic] of the squeegeeing unit 32.

It should be emphasized that, according to FIG. 3, the rear end of the central locking ribs 114 of the cleaning unit 30 projects rearwards beyond the rear ends of the adjacent locking ribs 112, 116 and, as has been mentioned, forms, as a front end side 70 of the receiving part 58 in the cleaning unit 30, a stop for the front end side 74 of the engagement part 60 of the squeegee unit 32 in FIG. 4. Consequently, the cleaning unit 30 and the squeegee unit 32 are connected to one another in a firm, but releasable manner as a combined hand-held implement 20 when the locking ribs and locking grooves of the two units 30, 32 engage fully one inside the other and are locked by the locking bolt 86. It is thus evident that the locking ribs and the locking grooves of the cleaning unit 30 and of the squeegee unit 32 form locking elements and the receiving openings thereof. If required, such locking elements may naturally also be present in the form of at least one bolt and a provided for this purpose at least one receiving opening in the units 30, 32, because it is only the axial and lateral securing of the two units which is essential when said units are assembled together to produce the hand-held implement 20. For this reason, if appropriate, the receiving part 58 and the engagement part 60 may also be configured as a latching connection by means of which the two units 30, 32 are held together, because, for this purpose, all that is required is for those end sides or longitudinal sides of the receiving part 58 and the engagement part 60 which are located opposite one another when the two units 30, 32 are in the assembled state to be equipped with mutually corresponding latching elements.

The above description of the hand-held implement 20 illustrates that said implement can be used, for example, as a window wiper in which the squeegee member 24 serves as a water squeegee and the cleaning member 22 serves as a window-cleaning means.

In this arrangement, the two units can be firmly connected to one another by means of the conical locking bolt 86 to produce the single hand-held implement 20 and can be separated again into two separate units 30, 32 by unscrewing the locking bolt 86. Since the locking bolt 86 is provided with the internal thread or the like at the rear end, an extension and/or a joint can be screwed into said internal thread if required. The locking bolt 86 may be screwed into the squeegee unit 32 or into the cleaning unit 30 alone and also my be screwed into the hand-held implement 20 made up of these two units 30, 32. Since, in the case of said assembled hand-held implement 20, the squeegee lip 54 and the cleaning pad 43 are located on the underside of the hand-held implement 20, the surface which is to be cleaned, e.g. a window, may be washed and dried in one operation. The cleaning liquid, such as water, produced during usage of the squeegee unit 32 is absorbed again by the cleaning pad 43.

Figure 11:
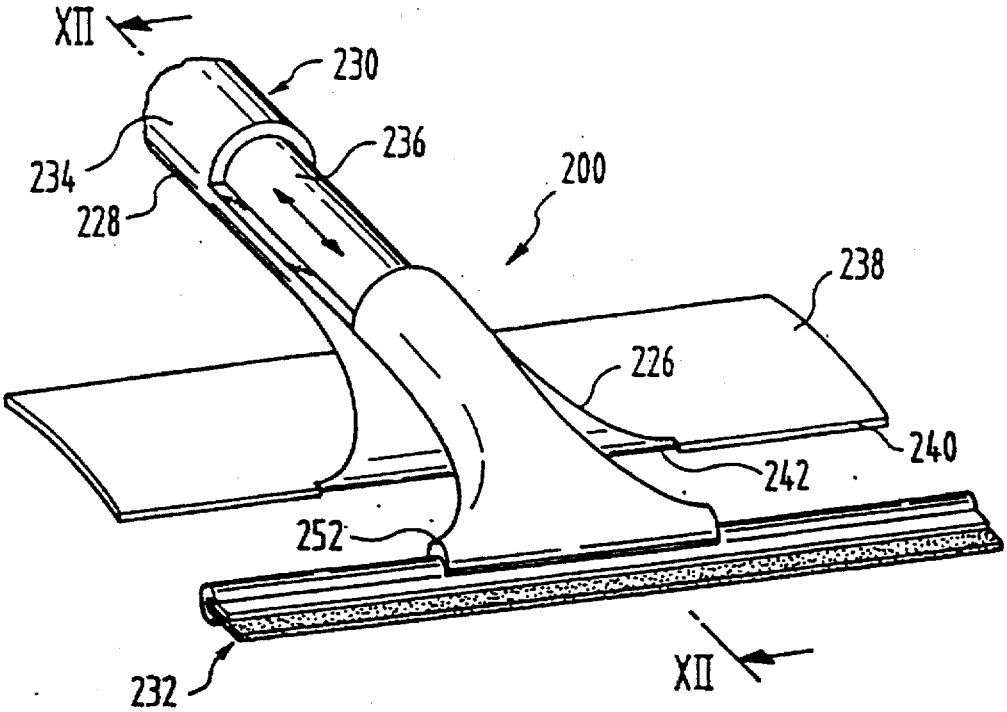
FIG. 11 shows a perspective, partially broken-away view of a second embodiment of a hand-held implement according to the invention, the implement being in a partially assembled state.

A second embodiment of the hand-held implement 200 according to the invention is illustrated in FIG. 11, this showing a connection of a cleaning unit 230 to a squeegee unit 232 which differs from the first embodiment.

A handle 228 of the hand-held implement 200 is made up of an outer, tubular handle 234 of the cleaning unit 230, the front end 226 of which, as in the previous embodiment, widens increasingly towards the front and is designed integrally with a transversely extending wiper plate 238. In FIG. 11, a preferably hollow, tubular handle 236 of the squeegee unit 232 is partially pushed coaxially into the tubular handle 234 of the cleaning unit 230. In the event of a further push-in movement of the squeegee unit 232, a rearwardly and downwardly directed stop strip 252 (not shown in any more detail in FIG. 11) of a squeegee mount strikes, as in the case of the above-described, first embodiment, against a centrally arranged stop edge 242, which is set back in parallel with respect to a front edge 240 of the wiper plate 238.

Figure 14:
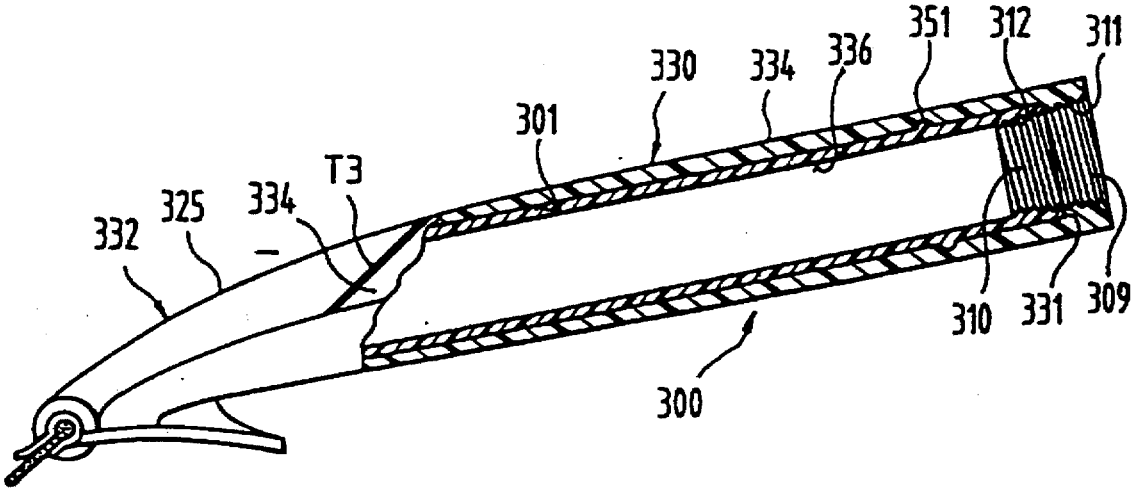
FIG. 14 shows a side view, partially in a center longitudinal section, of a third embodiment of a hand-held implement according to the invention, the implement being in the assembled state.
Figures 12, 13:
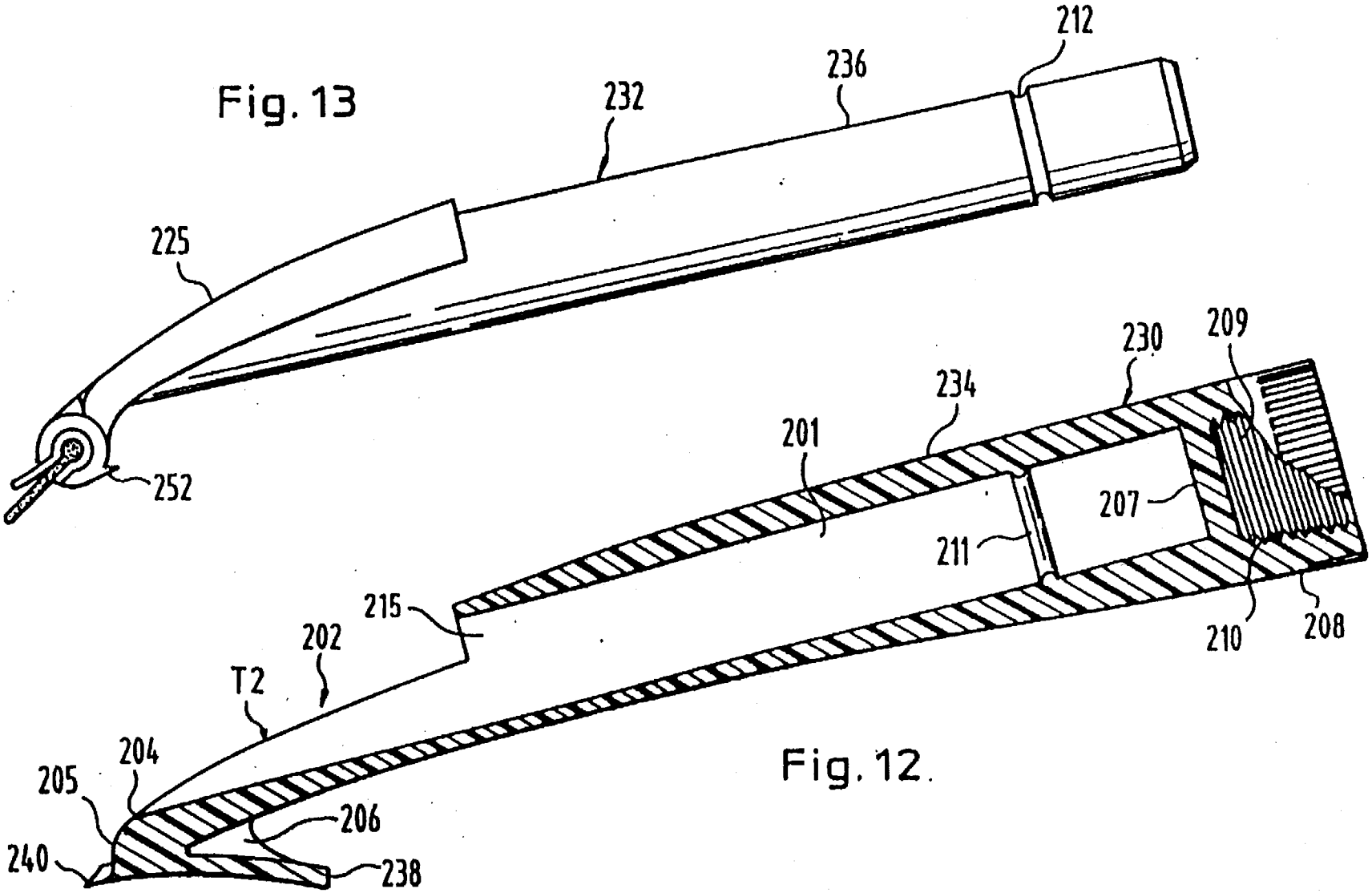
FIG. 12 shows a center longitudinal section, approximately along the section line XII—XII, of the cleaning unit in FIG. 11.
FIG. 13 shows a side view of the squeegee unit of the hand-held implement shown in FIG. 11.

A latching device (not shown in FIG. 11), which is described in more detail hereinbelow with reference to FIGS. 12 to 14, is provided between the outer surface of the tubular handle 236 of the squeegee unit 232 and the inner surface of a cylindrical cavity 201 of the tubular handle 234 of the cleaning unit 230, which latching device takes effect at the same moment at which the squeegee unit 232 has reached its full, above-described push-in end position in the handle 234 of the cleaning unit 230. In this arrangement, the latching device is such that the squeegee unit 232 rests, by means of its stop strip 252, against the front edge 240 of the wiper plate 238 with a certain degree of axial pre-stress. The magnitude of this pre-stress is such that, even under extreme working conditions in which relatively strong forces are exerted on the combined hand-held implement 200, the described connection, which is firm but can always be released by hand, between the cleaning unit 230 and the squeegee unit 232 remains intact.

According to FIG. 12, the tubular handle 234 of the cleaning unit 230 is provided with a front, upper cutout 202, which corresponds approximately to a third of the overall length of the cavity 201 or of the handle 234. The cutout 202 forms an approximately right-angled parting plane T2 of the hand-held implement 200. Said parting plane T2 is first of all directed vertically until it reaches approximately the centre longitudinal axis of the cleaning unit 230, and is then directed approximately horizontally in a soft curve forwards and downwards until it reaches the front, lower end 204 of a plug-in opening of the cavity 201. The parting plane T2 terminates in a bead-shaped end surface 205 of the cleaning head 223. The underside of the end surface 205 is connected integrally to the wiper plate 238, which is reinforced, on the rear side, with respect to the handle 234 by at least one reinforcement rib 206.

According to FIG. 12, the rear end of the cavity 201 is closed off by a transverse wall 207, beyond which the handle 234 extends by means of a rear, tubular end 208 which has an increased diameter and in which an axial opening 209 is provided. Said opening 209 extends to the transverse wall 207 and is tapered, in the form of a truncated circular cone, towards the transverse wall 207, the inner wall of the opening 209 being provided with an internal thread 210. Said axial opening 209 serves for the insertion of an auxiliary device, e.g. of an extension shaft.

As has been mentioned above, the handles 234 and 236 of the cleaning unit 230 and of the squeegee unit 232 form a constituent part of a locking device, which is designed here as a latching device and serves to produce a firm, but releasable connection between the two units when the latter has been fully pushed together. With reference to FIGS. 12 and 13, said latching device may comprise at least one protrusion, which is designed in FIG. 12 as an annular latching bead 211 on the inner wall of the cavity 201, which corresponds with an annular latching groove 212 on the outer side of the handle 236 of the squeegee unit 232 in FIG. 13. In this arrangement, the axial distance of the latching bead 211 from the front edge 240 of the wiper plate 238 and the axial distance of the latching groove 212 from the stop strip 252 of the cleaning unit 230 are selected such that, when the handle 236 has been fully pushed into the handle 234, the latching bead 211 exerts axial prestress, by way of the front edge 240, on the stop strip 252 of the squeegee unit 232 in order to achieve an axially firm connection between the cleaning unit 230 and the squeegee unit 232.

In FIG. 13, the squeegee unit 232 is represented with its handle 236 and a squeegee head 225. As shown in a comparison with the cleaning unit 230 in FIG. 12, the squeegee head 225 fills the cutout 202 of the handle 234 of the cleaning unit 230 to the full extent, this resulting in the combined hand-held implement 200 having a continuous surface which ensures convenient handling of the hand-held implement.

A third embodiment of a hand-held implement 300 according to the invention is represented in FIG. 14, in the case of which a parting plane T3, which is positioned at an acute angle to the rear with respect to the longitudinal axis of the cleaning unit 330, is provided between the squeegee unit 332 with squeegee head 325 and the cleaning unit 330 with a tubular handle 334. The rear ends both of the tubular handle 334 of the cleaning unit 330 and of the tubular handle 336 of the squeegee unit 332 are open and exhibit conical openings 309 and 310, respectively, which widen towards the rear. An axial, inner annular shoulder 331 is arranged on the inner side of the rear end of the hollow squeegee handle 334, the rear end of the handle 336 of the squeegeeing unit 332 resting against said shoulder. A latching device 351 similar to that in FIGS. 12 and 13 takes effect between the handles 334 and 336 of the two units 330, 332, and, in FIG. 14, an annular groove is provided in an inner wall 301 and a corresponding annular bead is provided on the outer side of the handle 336 of the squeegee unit 332, and they take effect in the manner which has already been described.

The openings 309 and 310 are each provided with an internal thread 311, 312 such that, when the two units 330, 332 are in the assembled state, they form a common, axial opening which widens in the form of a truncated circular cone towards the rear end, with the result that it is possible for a pole-like auxiliary device, such as an extension shaft, to be inserted, and fastened, only in the opening 309 of the cleaning unit 330 or only in the opening 310 of the squeegee unit 332, in order to use said units individually, or else into the screw-in opening formed in the two units together.

FIGS. 15 to 26 illustrate a fourth, particularly preferred embodiment of a hand-held implement 400 according to the invention, this containing further, releasable means for connecting a cleaning unit 401 to a squeegee unit 402. According to FIGS. 15 and 16, a handle 403 of the hand-held implement 400 is made up of an outer, tubular handle 404 of the cleaning unit 401, the front end 405 of which widens increasingly forwards and downwards, according to FIGS. 20 and 24, as cleaning head 406, is designed integrally with a transversely extending wiper plate 407, and is provided with an opening 431 at the rear end.

Figure 15:
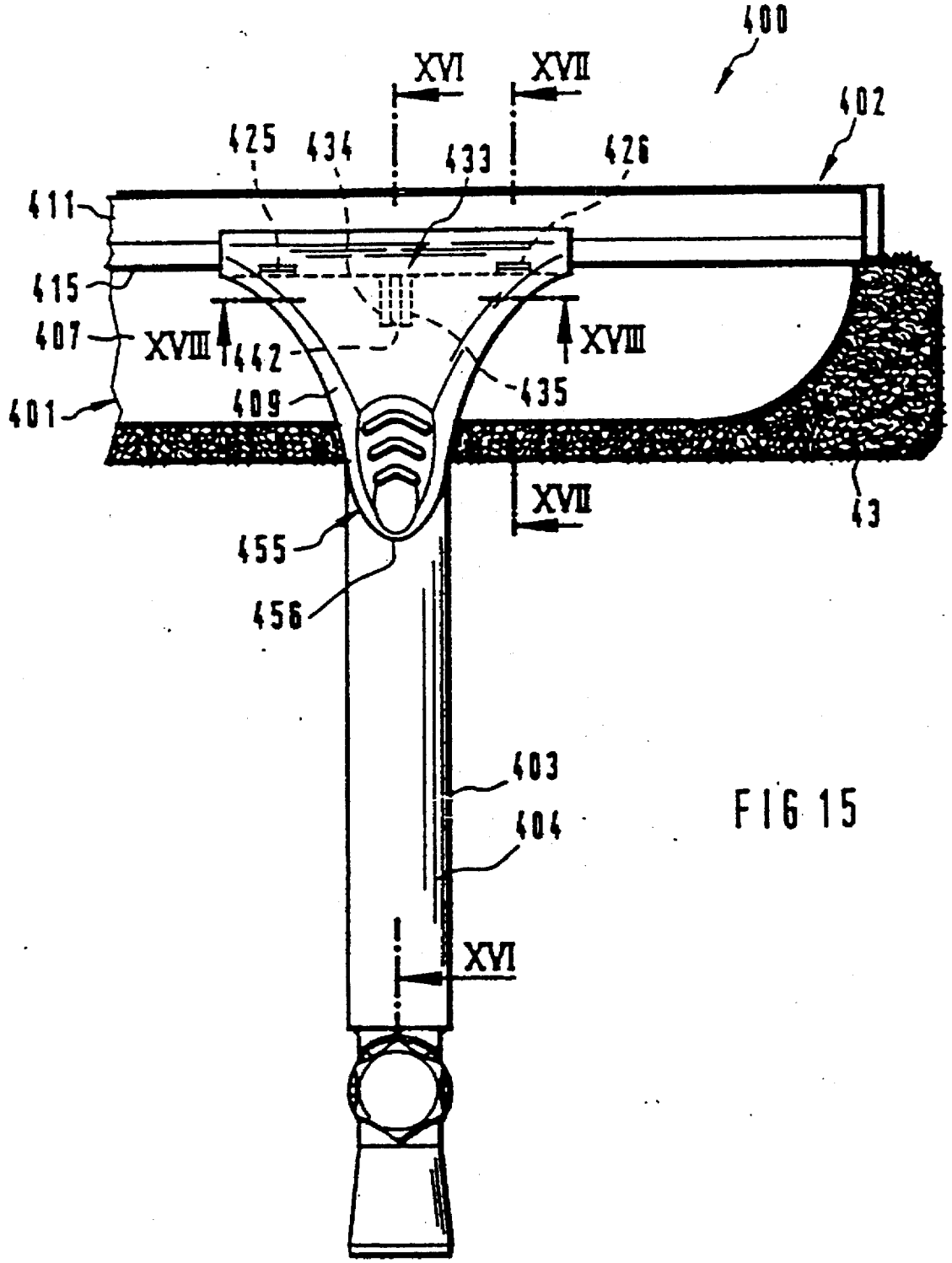
FIG. 15 shows a plan view of a fourth embodiment of a hand-held implement according to the invention, in a partially broken-away representation.
Figure 16:
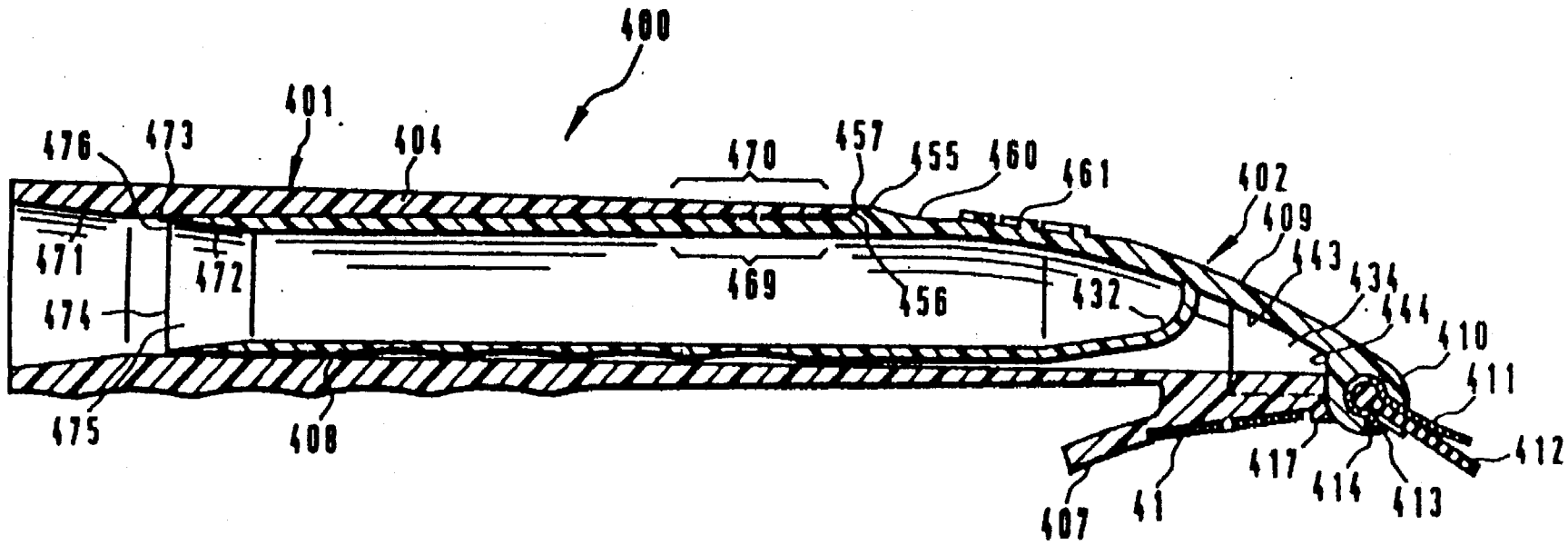
FIG. 16 shows a vertical center longitudinal section XVI—XVI of the hand-held implement in FIG. 15.

In FIGS. 15 and 16, a tubular handle 408 of the squeegee unit 402 is coaxially pushed telescopically into the handle 404 of the cleaning unit 401. The squeegee unit 402 has a squeegee head 409, the tubular squeegee mount 410 of which, in turn, receives a guide rail 411 for a squeegee lip 412. In this arrangement, the guide rail 411 engages in a flexible manner, by means of a central resilient tongue 413, into a front, central recess 414 of the squeegee mount 410 (FIGS. 16 and 22), with the result that the guide rail 411 with the squeegee lip 412 clamped firmly therein can be easily exchanged.

Figure 24:
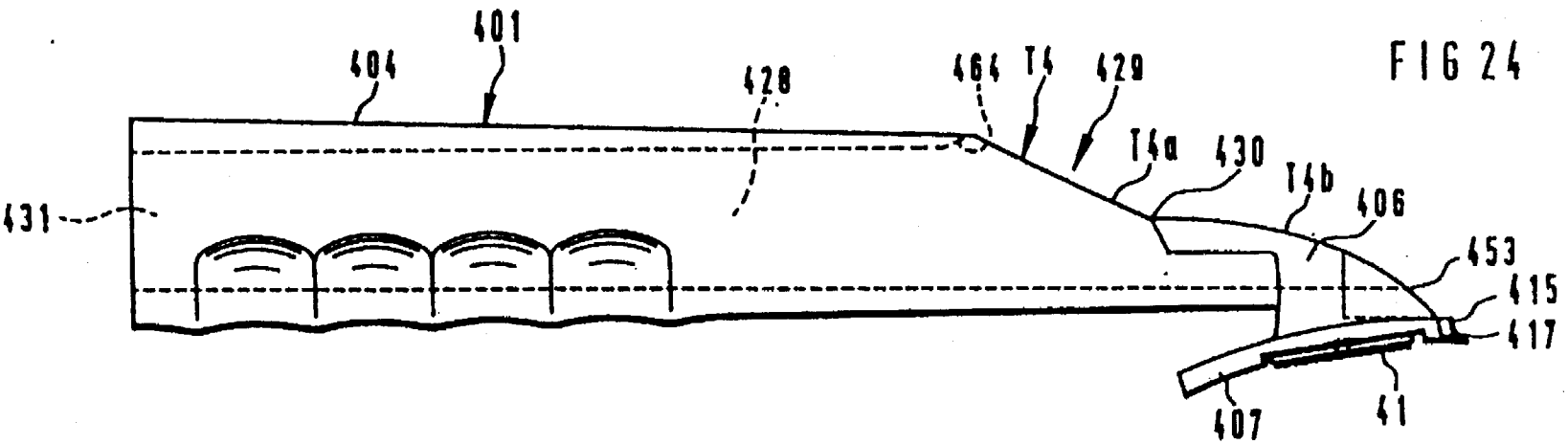
FIG. 24 shows a side view of the cleaning unit according to FIG. 20.

In the case of the hand-held implement 400 in FIG. 15, the guide rail 411 is located at a short distance in front of a front edge 415 of the wiper plate 407, the transverse profile of said front edge 415 being adapted to the radius of a cross-sectionally circle-arc-shaped rear edge of the guide rail 411, as FIG. 24 shows. According to FIGS. 20 and 24, the front edge 415 of the wiper plate 407, in turn, has a right-angled cutout 416 with a parallel stop surface 417, set back axially with respect to the front edge 415 of the wiper plate 407, for the squeegee mount 410 of the guide rail 411.

In FIGS. 15 to 17 and 18 to 20, a latching device 418 (FIG. 17) is provided between the outer surface of the handle 408 of the squeegee unit 402 and the inner surface of the cylindrical cavity of the handle 404 of the cleaning unit 401. Said latching device 418 begins to take effect just before the moment at which the squeegee unit 402 has reached its full, above-described push-in end position in the handle 404 of the cleaning unit 401. Consequently, the squeegeeing unit 402 rests, by means of its squeegee mount 410, against the stop surface 417 of the wiper plate 407 with a certain degree of axial prestress. The magnitude of said prestress is such that, even under extreme working conditions in which relatively strong forces are exerted on the combined hand-held implement 400, the described connection, which is firm but can be released by hand, between the cleaning unit 401 and the squeegeeing unit 402 remains intact.

Figure 17:
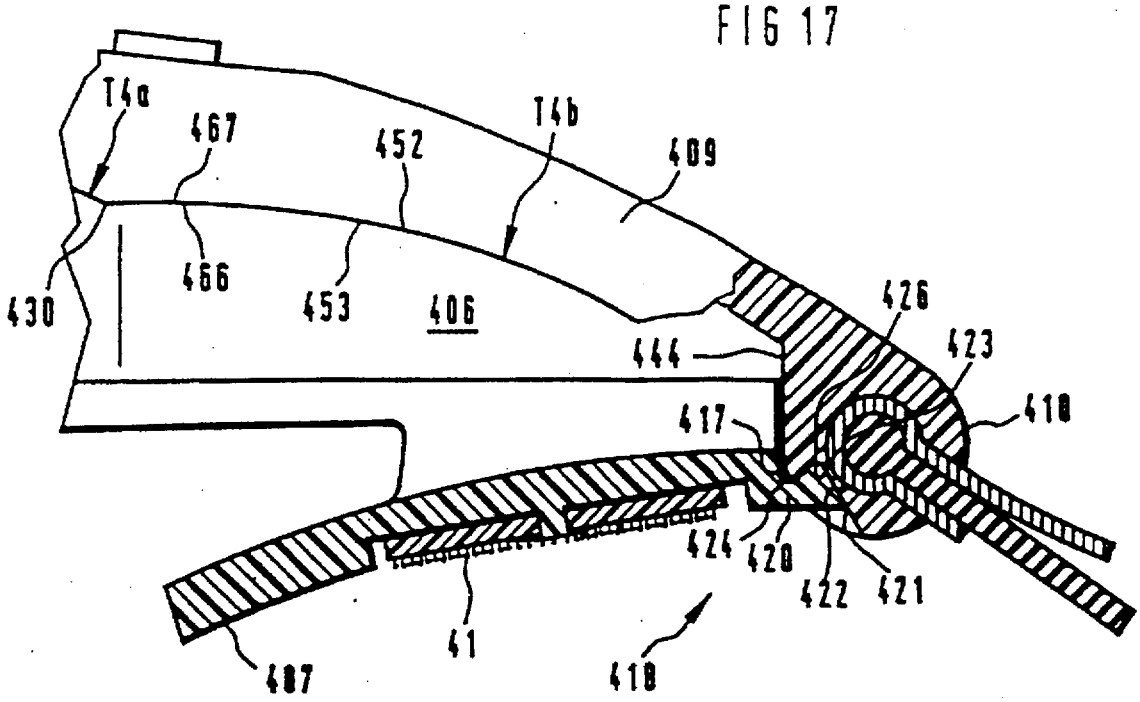
FIG. 17 shows a longitudinal section XVII—XVII of the hand-held implement in FIG. 15.
Figure 19:
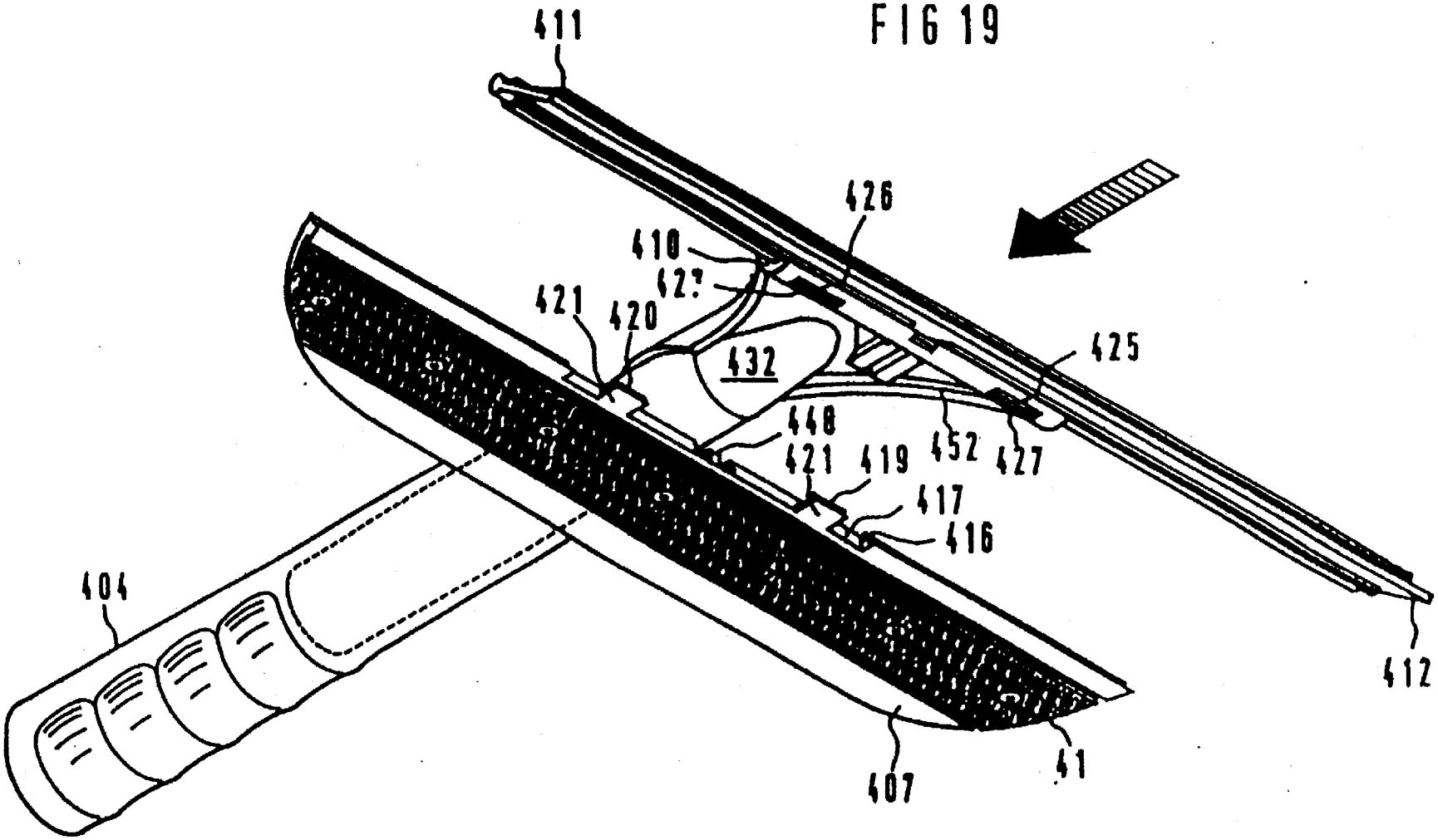
FIG. 19 shows a perspective bottom view of the hand-held implement according to FIGS. 15 to 18, the squeegee unit having been pushed partially into the cleaning unit.
Figure 20:
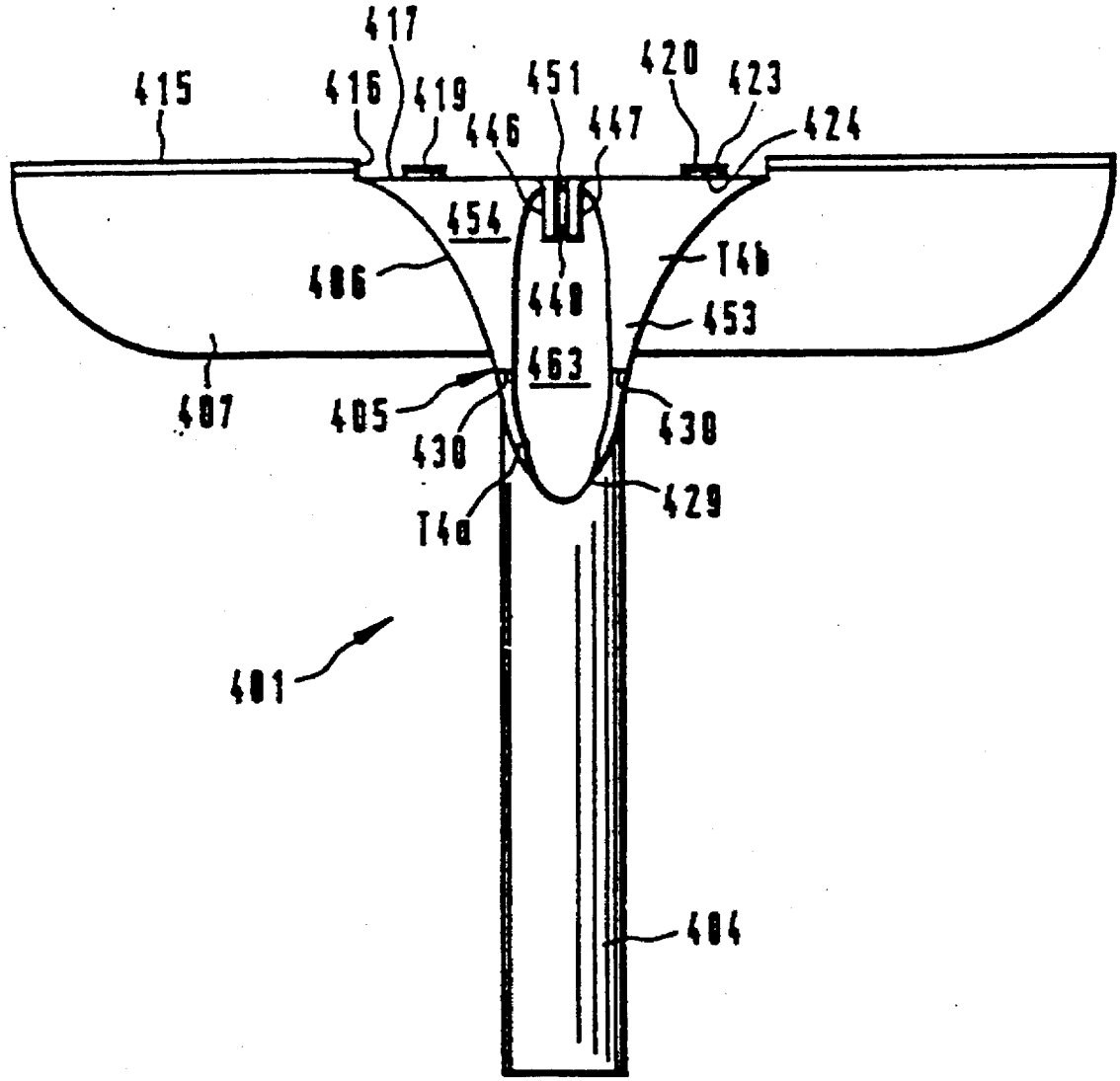
FIG. 20 shows a plan view of the cleaning unit of the hand-held implement in FIG. 15.

It can be seen, in particular, from FIGS. 17, 19 and 20 that two latching lugs 419, 420 project from the stop surface 417, the underside 421 of which latching lugs is in alignment with a touch-and-close fastening strip 41 which is fastened on the underside of the wiper plate 407 and has been described in more detail above with reference to FIG. 2. An upwardly and rearwardly extending run-on surface 422 at the front end of the latching lugs 419, 420 is, at the same time, part of an upper, transversely running latching rib 423, which drops rearwards and downwards into a latching groove 424 parallel to the latching rib 423. The latching groove 424 is bounded on the rear side by the stop surface 417 of the cutout 416. The height of the latching lugs 419, 420 extends to virtually half the height of the front edge 415 or the stop surface 417 of the wiper plate 407. Of course, it is also possible to use a smaller or greater number of latching lugs, even of different shaping, instead of the described number of two latching lugs 419, 420.

Figure 22:
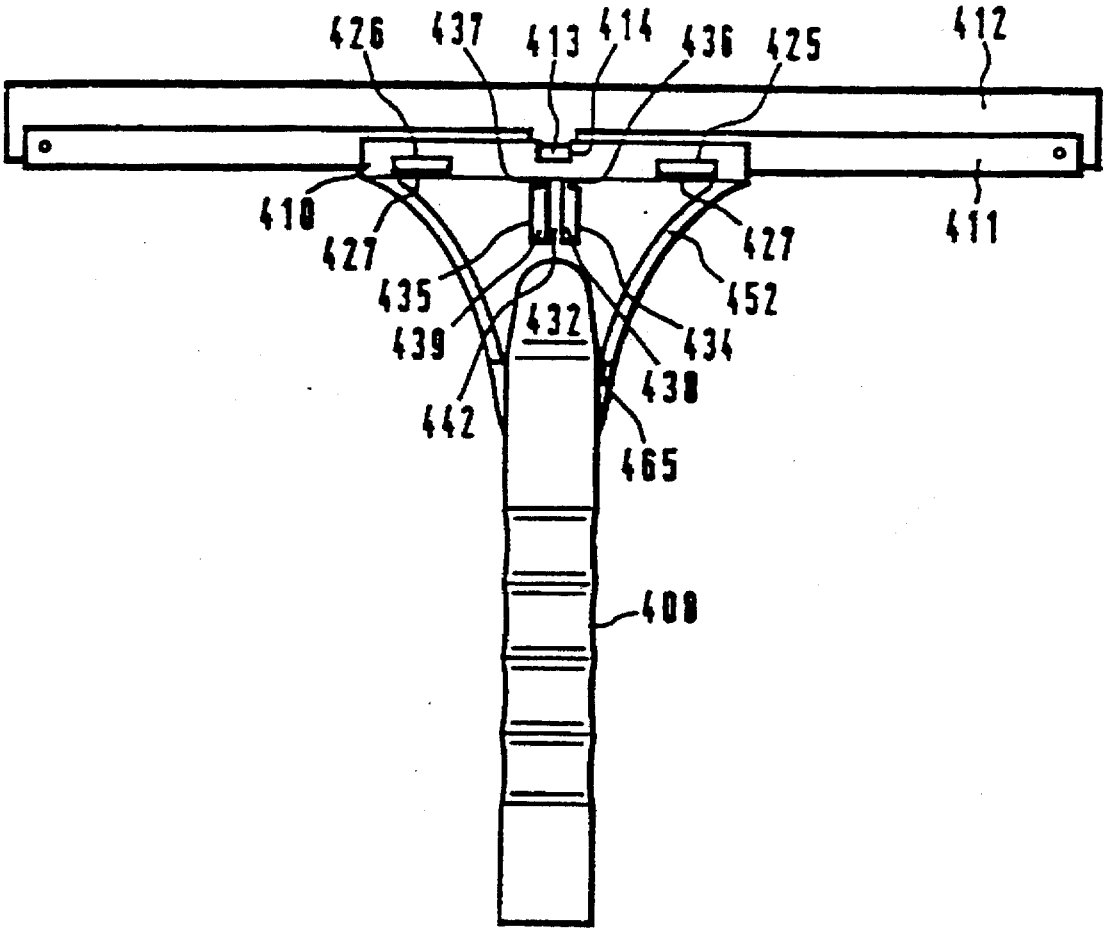
FIG. 22 shows a bottom view of the squeegee unit of the hand-held implement in FIG. 15.
Figure 23:
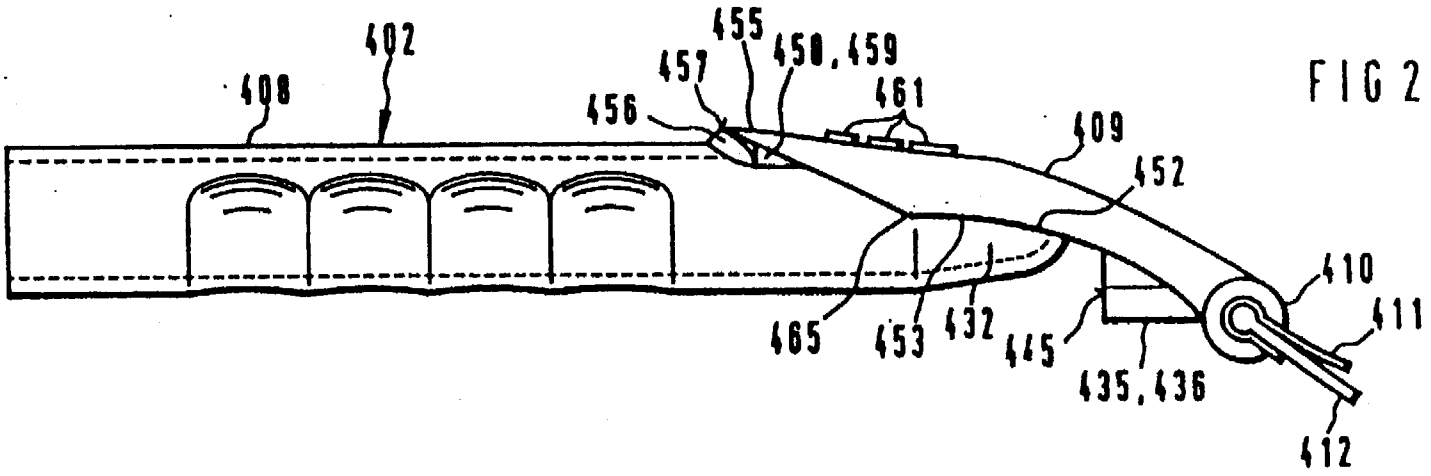
FIG. 23 shows a side view of the squeegee unit according to FIGS. 21 and 22.

According to FIGS. 17, 19 and 22, two latching recesses 425, 426 are provided on the underside of the squeegee mount 410 of the squeegee head 409, which latching recesses exhibit dimensions corresponding to the latching lugs 419, 420 of the cleaning unit 401. The latching recesses 425, 426 are provided with a rear boundary edge 427. When the squeegee unit 402 is pushed axially into the handle 404 of the cleaning unit 401, said boundary edge 427 of the squeegee unit 402 strikes against the oblique run-on surface 422 of the latching lugs 419, 420, before the latching lugs 419, 420 bend out elastically to latch into the latching recesses 425, 426 assigned to them and the two units 401, 402 are connected in a firm, but releasable manner.

In accordance with this fourth embodiment of the hand-held implement 400, there are a number of possible ways to produce the releasable connection between the two units 401, 402, in an extremely simple manner and such that said connection is essentially invisible to the user, either in combination with one or more of the above-described fastening devices which can be released by hand, e.g. the latching device 418, between the tubular squeegee mount 410 of the squeegee unit 402 and the wiper plate 407 of the cleaning unit 401, or merely with the aid of one or more frictionally locking or clamping connections directly between the two said units 401, 402. This is because such frictionally locking connections which can be released by hand may also be quite sufficient on their own, should this be desired, to connect the two units 401, 402 to one another firmly enough, but such that they can be released by hand.

FIGS. 15, 16, 18 to 20 and 22 to 24 show the fourth exemplary embodiment of the hand-held implement 400 according to the invention with a first embodiment of such a frictionally locking connection. Said frictionally locking connection is designated by 433 and comprises a clamping tongue/clamping groove connection made up of at least one clamping tongue and of at least one associated clamping groove. Two clamping tongues 434, 435 can be seen in FIGS. 15, 16, 18, 19, 22 and 23, and these clamping tongues are formed integrally with the squeegee head 409 and project vertically from the underside thereof. According to FIG. 22, the axially front end of the clamping tongues 434, 435 are connected, by means of a connecting web 436, 437 in each case, to the rear side of the tubular squeegee mount 410 and the underside of the squeegee head 409. Said connecting webs 436, 437 are narrower, and thus more flexible, than the clamping tongues 434, 435 and thus impart a desired additional lateral flexibility to the clamping tongues; they have, for example, an axial length of approximately 2 mm and a width of approximately 1.5 mm, while the width of the free, lower longitudinal edge 438, 439 of the clamping tongues 434, 435 corresponds approximately to 4 mm. According to FIG. 18, the clamping tongues 434, 435 have a transverse profile of which the width is reduced towards the top, from the lower longitudinal edge 438, 439 of each clamping tongue 434, 435, in each case on their outer side 434*a*, 435*a* to a smaller width of, for example, 3 mm. This widening of each cliping tongue 434, 435 extends preferably over only a bottom third, e.g. over only 4 mm of their overall height. Furthermore, together with the underside, curved forwards and downwards, of the squeegee head 409, said surfaces 440, 441, located at a distance opposite one another, of the two clamping tongues 434, 435 form a center longitudinal groove 442 which is open towards the bottom and rear and of which the profile is similar to that of an upside-down U. Said side surfaces 440, 441, which form the groove walls of the center longitudinal groove 442 and belong to the clamping tongues 434, 435, enclose an acute angle which is open towards the bottom and are directed parallel to the center longitudinal axis of the squeegee unit 402. In a common plane parallel to the centre longitudinal axis of the squeegee unit 402, the lower, free longitudinal edges 438, 439 are arranged at a level which runs at a distance above the latching recesses 425, 426 of the tubular squeegee mount 410.

The clamping tongues 434, 435 project freely to the rear from the tubular squeegee mount 410 over a length of, for example, approximately 16 mm and have a trapezoidal surface area in side view (FIG. 16). A head wall 443 in FIGS. 16 and 18 which is formed by the underside of the squeegee head 409 and belongs to the acute-angled center longitudinal groove 442 open towards the bottom forms an obtuse angle (FIG. 16) with a vertical, planar rear side 444 of the tubular squeegee mount 410 in FIG. 17 to which the front ends of the clamping tongues 434, 435 are connected.

In FIGS. 16, 19, 22 and 23, the front end 432 of the handle 408 of the squeegee unit 402 tapers conically and terminates at a short, axial distance in front of the rear end sides 445 of the clamping tongues 434, 435.

Figure 18:
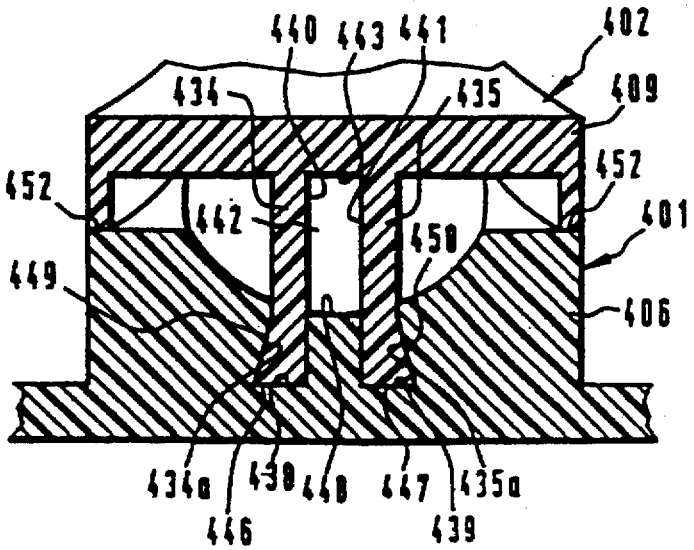
FIG. 18 shows a cross-section XVIII—XVIII of the hand-held implement in FIG. 15.

In FIGS. 18 and 20, the cleaning unit 401 is provided with two clamping grooves 446, 447 at the front end of the cutout 429, which encloses a plug-in opening 463, in the centre of the inner wall of the handle 404, said inner wall being approximately U-shaped in cross-section there. Said clamping grooves 446, 447 have a cross-section in the manner of a dovetail, that is to say widening towards the groove base, and serve to receive the cross-sectionally similar clamping tongues 434, 435 of the squeegee unit 402. The clamping grooves 446, 447 extend on both sides parallel to a vertical center longitudinal plane of the cleaning unit 401 and are separated by a central guide tongue 448 which is provided for approximately axial engagement into the central, clamping centre longitudinal groove 442 which is approximately U-shaped upside-down and belongs to the squeegeeing unit 402. Accordingly, the clamping grooves 446, 447 are dimensioned to be slightly longer than the clamping tongues 434, 435 and are closed at the rear end. As has been mentioned, the two clamping grooves 446, 447 are undercut such that outer groove walls 449, 450 of the clamping grooves 446, 447, together with the mutually parallel side walls of the guide tongue 448 which are located opposite them, enclose an angle which widens towards the groove base, but becomes smaller towards the rear, closed end of the clamping grooves 446, 447. Consequently, when they are pushed axially into the clamping grooves 446, 447, the two clamping tongues 434, 435 of the squeegee unit 402 are pressed to an increasingly pronounced extent against the two sides of the guide tongue 448 until a frictionally locking connection which is firm, but can be released by hand is achieved (FIGS. 20 and 24).

Frictional locking or a clamping fit between the cleaning unit 401 and squeegee unit 402 may be achieved in addition to the above-described frictionally locking connection 433, or else on its own, by a further frictionally locking connection directly between the two units 401, 402. According to FIGS. 15 to 24, said frictionally locking connection can be achieved by frictional locking between a front, upper end 451 of the central guide tongue 448 of the cleaning unit 401 and the head wall 443, curved forwards and downwards, of the squeegee head 409, in the center longitudinal groove 442 which is open towards the bottom, by an increasing frictional restraint when the guide tongue 448 of the squeegeeing unit 402 is pushed into the cleaning unit 401.

A particularly advantageous frictionally locking action between the two units 401, 402, which connection can be achieved directly, that is to say without any additional parts, can be realized as is described below:

According to FIGS. 20 and 24, an axially extending, approximately cylindrical cavity 428 in the handle 404 of the cleaning unit 401 is provided with a front, upper cutout 429 which corresponds approximately to a third of the overall length of the handle 404. Said cutout 429 runs along a parting plane T4 with respect to the squeegee head 409 of the squeegee unit 402 in FIG. 23. A first, rear and planar-surface section T4*a* of said parting plane T4 is directed obliquely forwards and downwards, from the upper side of the handle 404 to the front end of the hand-held implement 400, until it reaches approximately the center longitudinal plane of the handle 404, thus encloses, with said centre longitudinal plane, an obtuse angle which is open towards the top as far as the front end of the handle 404. The vertex of said obtuse angle forms a step 430, after which a second, front section T4*b* of the parting plane T4 is curved first of all gradually and then to a more pronounced extent forwards and downwards and runs out into the vertical stop surface 417 of the cutout 416 of the wiper plate 407.

Figure 21:
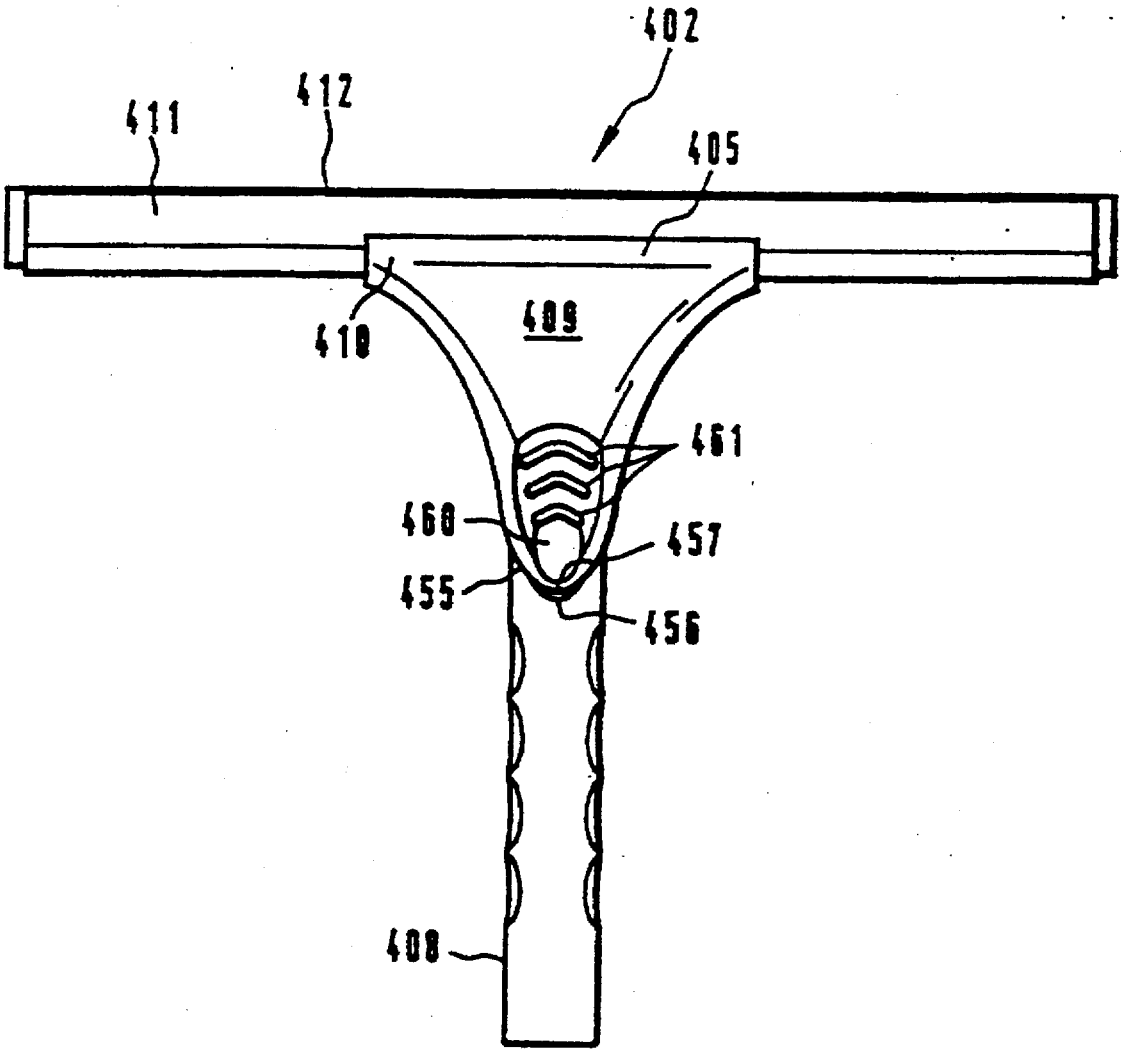
FIG. 21 shows a plan view of the squeegee unit of the hand-held implement in FIG. 15.

A border 452 of the underside of the squeegee head 409 in FIGS. 17, 18, 19, 22 and 23 naturally corresponds to the contour of a border 453 of the cutout 429 of the handle 404 and/or of the upper side of the cleaning head 406 (FIG. 20), with the result that, when the units 401, 402 are in the assembled state, the hand-held implement 400 has a smooth surface in the region of the parting plane T4. According to FIGS. 15 and 21, the rear, increasingly narrow and [sic] end of the squeegee head 409 is shaped as a nose 455 which is round in plan view. The nose 455 is bounded by a rear end surface 456 which projects obliquely upwards and forwards, in the manner of a truncated-cone cutout, from the cylindrical outer side of the handle 408 of the squeegee unit 402 to a rear, round upper edge 457 of the nose 455. On the two opposite longitudinal sides, the nose 455 is bounded by mutually parallel, vertical guide surfaces 458, 459 which are triangular in side view and of which only the right-hand guide surface 458 can be seen in FIG. 23. The downwardly projecting border 452 of the underside of the squeegee head 409 adjoins said guide surfaces 458, 459. In the region of the nose 455, the upper side of the squeegee head 409 according to FIGS. 16 and 21 is provided with a finger depression 460 and a plurality of arrow-shaped gripping ribs 461, which make it easier for the frictional locking or clamping-type locking between the cleaning unit 401 and the squeegee unit 402 to be eliminated by hand.

Corresponding to the described, rearwardly projecting end surface 456 of the nose 455 of the squeegee head 409, the border 453 of the cutout 429, which forms the plug-in opening 463 and belongs to the tubular handle 404 of the cleaning unit 401, is provided on its upper side with a groove-like chamfer 464 which is directed into the plug-in opening 463 (FIG. 24). Said chamfer 464 is directed obliquely rearwards and downwards into the interior of the handle 408 of the squeegee unit 402 and is of a width which corresponds to the distance between the two vertical, axis-parallel guide surfaces 458, 459 in the region of the nose 455 of the squeegee head 409. Consequently, the frustoconical end surface 456 of the nose 455 can engage fully, by means of its lateral guide surfaces 458, 459, into the plug-in opening 463 of the tubular handle 404 of the cleaning unit 401, in the region of said chamfer 464, and the nose 455 of the squeegee head 409 can come to rest flush against the border 462 of the cutout 429.

In order to achieve frictionally locking connection between the squeegee unit 402 and cleaning unit 401 when the two units are in the push-in end position, run-on or frictionally locking surfaces 466, 467 are formed by a border 453, which is curved to the front and rear and encloses the plug-in opening 463 of the cleaning unit 401, of the upper side 454 of the cleaning head 406 and the underside, correspondingly curved border 452 of the squeegee head 409. For this purpose, the curvature of the rear frictionally locking surface 466, which is located in front of a vertex which forms a step 465, of the border 453 of the cleaning head 406 rises to a level by which frictional locking with the squeegee unit 402 is determined. If the two said frictionally locking surfaces 466, 467 of the cleaning head 406 and of the squeegee head 409 approach one another before the squeegee unit 402 has reached the push-in end position in the cleaning unit 401, the upper side of a front length section 469, which is located behind the squeegee head 409, of the handle 408 of the squeegee unit 402 is raised to such a pronounced extent, and pressed against a front length section 470 on the upper side of the inner wall of the handle 404 of the cleaning unit 401, that the desired frictional locking or clamping fit is achieved reliably in each case when the two units 401, 402 are in the push-in end position.

The above described latching and frictionally locking connections may, as described, be used either alone or, as represented for the present fourth embodiment, together with one or more of the described frictionally locking connections for the two units 401, 402. When the two connecting means are used together, these may be matched to one another such that, at the end of the push-in movement of the squeegee unit, the operator can clearly feel the latching device latching in, or the frictional locking, if appropriate by the squeegee unit 402 striking against the cleaning unit 401.

FIG. 22 represents a bottom view of the squeegeeing unit 402 with its hollow-cylindrical handle 408 and its squeegee head 409 which, as a comparison with the cleaning unit 401 in FIG. 20 shows, completely fills the cutout 429 of the handle 404 of the cleaning unit 401 such that a flush, smooth surface of the combined hand-held implement 400 is produced. This permits convenient handling of the combined hand-held implement 400 as well as separate handling of only the cleaning unit 401 or of only the squeegee unit 402, because the means which produce a latching or frictionally locking connection are virtually invisible to the user and do not require any shaping which obstructs their handling. An auxiliary device, e.g. an extension shaft, may be inserted into a rear opening of the handles 404, 408 in FIGS. 23 and 24. The opening in the handle 404 is designated by 431.

It is, furthermore, evident that the latching connection could merely comprise latching protrusions which are provided on one of the mutually opposite surfaces and interact with depressions which either correspond to the shape of the protrusions or else, as in the case described, latch into annular grooves or differently shaped latching recesses in the opposite surface.

The above designs of the second, third and fourth embodiments of the hand-held implements 200, 300 and 400 according to the invention show that the hand-held implement in each case comprises only the associated cleaning unit and squeegee unit, which can be combined with one another to produce the hand-held implement simply by sliding their handles telescopically one inside the other until the squeegee head strikes against the cleaning head and/or by positive locking and/or frictional locking, and—if it be desired—can also be separated from one another merely by separating axially by hand in the direction of the arrow in FIG. 11, the resistance exerted by the releasable connections being overcome in the process. Furthermore, the invention provides the advantage that, over their entire length, the two handles have a round or oval cross-section and thus permit particularly convenient handling, as in the case of cleaning units and squeegeeing units which have been separated from one another, it being possible for the surface of the handles to be contoured in a rib-like manner in order to provide better grip and to make it easier to push the handles telescopically relative to one another.

Finally, it should be mentioned that, according to FIG. 16, the rear ends of the tubular, hollow-cylindrical handles 404, 408 of the cleaning unit 401 and of the squeegee unit 402 are open and each exhibit a section 471, 472 which tapers inwards in the form of a truncated circular cone. These sections 471, 472 of the handles 404, 408 of the two units 401, 402 may form an identical, outwardly opening cone angle. However, the diameter of the inner end of the conical end section 471 of the cleaning unit 401 is dimensioned to be smaller than the diameter of its otherwise approximately cylindrical cavity, this resulting in the formation of an annular shoulder 473, which can serve as a stop for a rear end 474 of the handle 408 of the squeegee unit 402. On the other hand, the internal diameter of an opening 475 in the rear end 474 of the handle 408 of the squeegee unit 402 is smaller than the internal diameter of the inner annular shoulder 473 in the handle 474 of the cleaning unit 401, with the result that the rear end 474 of the handle 408 of the squeegee unit 402 forms an inner annular shoulder which, although it rests partially against the annular shoulder 476 then the two units 401, 402 have been pushed together, projects radially inwards beyond said annular shoulder 476. Consequently, the two conical end sections 471, 472 of the handles 404, 408 of the two units 401, 402 are graduated with respect to one another in terms of diameter and may serve for receiving, directly or indirectly, an actuating rod for working with the combined hand-held implement 400 or for working in each case with only the cleaning unit 401 or with only the squeegee unit 402.

We claim:

1. A hand-held implement for cleaning smooth surfaces and for wiping washing liquid from the surfaces, the implement comprising a cleaning unit including a cleaning member, a carrier for the cleaning member, and a handle, which extends from the carrier for the cleaning member, the implement further comprising a squeegee unit including a squeegee member, a carrier for the squeegee member, and a handle, which extends from the carrier for the squeegee member and defines a longitudinal axis, the squeegee member being arranged at the front end of the handle of the squeegee member and extending transversely with respect to the longitudinal axis, the implement further comprising means for connecting the cleaning and squeegee units to one another in a releasable manner, at the handles of the cleaning and squeegee units and at the carriers of the cleaning and squeegee units, so that the cleaning and squeegee units are also capable of being used separately.

2. The hand-held implement according to claim 1, wherein the connecting means provides a releasable connection between the handle of the cleaning unit and the handle of the squeegee unit.

3. The hand-held implement according to claim 1, wherein the connecting means provides a releasable connection of the cleaning unit to the squeegee unit, between the carriers for the cleaning member and the squeegee member.

4. The hand-held implement according to claim 3, wherein the handle of the cleaning unit has a front end and defines a longitudinal axis and wherein the carrier for the cleaning member is a wiper plate which is fastened at the front end of the handle of the cleaning unit so as to extend transversely with respect to the longitudinal axis of the handle of the cleaning unit, and which has a front edge, and which has a stop surface along the front edge, the stop surface bearing against the squeegee unit when the cleaning unit is connected to the squeegee unit.

5. The hand-held implement according to claim 4, wherein the stop surface of the wiper plate is defined by at least one cutout on the front edge of the wiper plate.

6. The hand-held implement according to claim 5, wherein the front edge of the wiper plate has a width and the cutout is provided midway along the width of the front edge of the wiper plate, the squeegee unit including a squeegee mount revived by the cutout when the cleaning unit is connected to the squeegee unit, the squeegee member including a guide rail fastened removably to the squeegee mount, the squeegee unit including a squeegee lip held by the guide rail.

7. The hand-held implement according to claim 6, wherein the squeegee mount is arranged transversely with respect to the longitudinal axis defined by the handle the squeegee unit, at the front end of the handle of the squeegee unit, and is provided with a stop strip coating with the stop surface of the wiper plate of the cleaning unit.

8. A hand-held implement according to claim 7, wherein the handle of the cleaning unit has a rear end and wherein the stop strip, being hook-shaped in cross-section, is directed toward the rear end of the handle of the cleaning unit.

9. A hand-held implement according to claim 1, wherein the means for connecting the cleaning and squeegee units to one another in a releasable manner, at the handles of the cleaning and squeegee units.

10. A hand-held implement according to claim 9, wherein the locking device comprises means for effecting a plug-in connection between the handles of the cleaning unit and of the squeegee unit.

11. A hand-held implement according to claim 10, wherein the handle of the squeegee unit defines an engagement part and wherein the handle of the cleaning unit defines a receiving part, which is arranged to receive the engagement part of the handle of the squeegee part, so as to effect the plug-in connection.

12. A hand-held implement according to claim 11, wherein the receiving part defined by the handle of the cleaning unit and the engagement part defined by the handle of the squeegee unit extend respectively along parts of the respective handles.

13. A hand-held implement according to claim 11, wherein the receiving part and the engagement part are provided at rear portions of the handles of the cleaning unit and of the squeegee unit.

14. A. hand-held implement according to claim 11, wherein the receiving part is provided in an upper portion of the cleaning unit and wherein the engagement part is provided at a lower portion of the squeegee unit.

15. A hand-held implement according to claim 11, wherein the receiving part in the upper portion of the cleaning unit defines a hollow which is U-shaped in cross-section.

16. A hand-held implement according to claim 15, wherein the cross-sectionally U-shaped hollow of the receiving part has a width and extends, in a longitudinal direction along the cleaning unit, over a length which is dimensioned to be greater than the width of the U-shaped hollow.

17. A hand-held implement according to claim 15, wherein the handle of the cleaning unit has a front end and wherein the U-shaped hollow is tapered conically and narrows toward the front end of the handle of the cleaning unit.

18. A hand-held implement according to claim 15, wherein the engagement part of the squeegee unit has a front end portion and a rear end portion and wherein the receiving part of the cleaning unit, at the hollow defines a front stop for the front end portion of the engagement part of the squeegee unit and a rear stop for the rear end portion of the engagement part of the squeegee unit.

19. A hand-held implement according to claim 11, wherein, as seen in longitudinal section, the receiving part of the cleaning unit has side surfaces which at least partially bound the hollow and which define an acute angle which opens towards the upper portion of the cleaning unit.

20. A hand-held implement according to claim 10, wherein the handle of the cleaning unit is generally tubular with a cavity having an internal diameter and with an open front end defining a plug-in opening, wherein the handle of the squeegee unit is generally cylindrical and has an external diameter corresponding approximately to the internal diameter of the generally tubular handle of the cleaning unit, and wherein the generally cylindrical handle of the squeegee unit plugs into the cavity of the generally tubular handle of the cleaning unit in a telescoping manner.

21. A hand-held implement according to claim 20, further comprising means including a latching device for locking the cleaning unit and the squeegee unit as a hand-held combination when the generally cylindrical handle of the squeegee unit is plugged into the cavity of the generally tubular handle of the cleaning unit in a telescoping manner.

22. A hand-held implement according to claim 21, wherein the generally tubular handle of the cleaning unit has a front portion defining an upwardly opening cutout, which encloses a portion of the plug-in opening for the generally cylindrical handle of the squeegee unit, which is curved forwards and downwards, starting from a horizontal center longitudinal plane through the cleaning unit, and which is adapted for receiving a part of the squeegee member and a part of the handle of the squeegee unit.

23. A hand-held implement according to claim 20, wherein the handle of the cleaning unit has a transverse wall terminating the internal cavity at a rear end of the internal cavity, wherein the handle of the cleaning unit extends rearwards from the transverse wall and is provided at the rear end of the cavity with an axial opening extending rearwards of the transverse wall, the axial opening being adapted for receiving and fastening an auxiliary device.

24. A hand-held implement according to claim 23, wherein the handle of the cleaning unit has a rear opening and the handle of the squeegee unit has a rear opening and wherein the rear openings of the respective handles are arranged directly one behind the other in an axial direction when the cleaning and squeegee units are in an assembled state, in which the cleaning and squeegee units are connected to one another, whereby the rear openings of the respective handles together from an opening which tapers, in the form of a truncated circular cone, in a frontwards direction and which is adapted for receiving an auxiliary device.

25. A hand-held implement according to claim 9, wherein each of the handles of the cleaning unit and of the squeegee unit has a rear end and wherein the locking device is provided at the rear ends of the respective handles of the cleaning unit and of the squeegee unit.

26. A hand-held implement according to claim 25, wherein the rear end of the handle of the cleaning unit defines a locking sleeve with a through-opening, wherein the rear end of the engagement part of the squeegee unit defines an axial recess, wherein the through-opening of the locking sleeve and the recess of the squeegee unit form a coaxial locking opening, and wherein the hand-held implement further comprises a locking bolt inserted into the locking opening.

27. A hand-held implement according to claim 26, wherein the locking opening has an inner wall which is tapered conically toward a front portion of the axial recess in the engagement part of the squeegee unit and wherein the locking bolt has a conical form which approximately corresponds to the locking opening.

28. A hand-held implement according to claim 26, wherein the locking bolt has an outer end which is open and which is provided with an internal thread into which an auxiliary device can be screwed.

29. A hand-held implement according to claim 1, wherein the handle of the cleaning unit defines a longitudinal groove in front of the receiving part, wherein the hand-held implement further comprises a securing device which includes a first part provided on the cleaning unit and a second part provided on the squeegee unit, and wherein the first and second parts of the securing device interact in order to prevent the squeegee unit and the cleaning unit from moving laterally relative to one another when the cleaning and squeegee units are in an assembled state, in which the cleaning and squeegee units are connected to one another.

30. A hand-held implement according to claim 29, wherein the interacting parts of the securing device define a groove/tongue connection between the respective handles of the cleaning unit and of the squeegee unit and wherein the interacting parts of the securing device extends axially with respect to the longitudinal axis defined by the handle of the squeegee unit.

31. A hand-held implement for cleaning smooth surfaces and for wiping washing liquid from the surfaces, the implement comprising a cleaning member provided with a handle and a squeegee member provided with a handle having a front end and defining a longitudinal axis, the squeegee member being arranged at the front end of the handle of the squeegee member and extending transversely with respect to the longitudinal axis, wherein the cleaning member is a part of a cleaning unit and the squeegee member is a part of a squeegee unit, the implement further comprising means including at least one fastening device for connecting the cleaning and squeegee units to one another in a releasable manner so that the cleaning and squeegee units are also capable of being used separately, the cleaning unit including a wiper plate having a stop surface, the squeegee unit including a tubular squeegee mount, the squeegee member including a guide rail fastened removably to the tubular squeegee mount, the squeegee unit including a squeegee lip held by the guide rail, wherein the connecting means comprises a latching device with latching lugs, which project from the stop surface of the wiper plate of the cleaning unit, and which coact with corresponding latching recesses in the tubular squeegee mount.

32. The hand-held implement according to claim 31, wherein the releasable fastening device for connecting the cleaning unit and the squeegee unit provides a frictionally locking connection between the cleaning and squeegee units.

33. The hand-held implement according to claim 32, wherein the frictional locking connection is a tongue and groove connection.

34. The hand-held implement according to claim 33, wherein the squeegee unit has a squeegee head unitary with and extending transversely from at a front portion of the squeegee head and wherein the releasable locking device comprises tongues projecting from an underside of the squeegee head and connected to a rear side of the squeegee mount.

35. The hand-held implement according to claim 34, wherein the tongues are connected to the rear side of the squeegee mount by flexible connecting webs which are narrower than the tongues.

36. The hand-held implement according to claim 34, wherein the tongue and groove connection is a dovetail connection.

37. The hand-held implement according to claim 36, wherein the tongues have an overall height as measured from the underside of the squeegee head and wherein each of the tongues is widened into a dovetail shape extending over only approximately a bottom third of the overall height as measured therefrom.

38. The hand-held implement according to claim 34, wherein the squeegee head has a head wall, from which two said tongues project, wherein each of said two tongues has a side surface spaced from and facing the side surface of the other one of said two tongues, and wherein the squeegee head has a groove extending in a direction parallel to the longitudinal axis defined by the handle of the squeegee member, the groove being bounded by the head wall of the squeegee head and by the side surfaces of said two tongues, and wherein the side surfaces of said two tongues open downwardly from the upper wall at an acute angle.

39. The hand-held implement according to claim 38, wherein the cleaning unit has a guide tongue extending axially with respect to the axis defined by the handle of the cleaning unit, separating the grooves of the cleaning unit, and serving for engagement into the groove of the squeegee head.

40. The hand-held implement according to claim 39, wherein the handle of the cleaning unit has a front end and wherein each of the grooves has a front, open end and a rear, closed end and is tapered from the front, open end to the rear, closed end at the front end of the handle of the cleaning unit, such that the tongues of the squeegee unit take up a clamping fit when received by the grooves of the cleaning unit.

41. The hand-held implement according to claim 34, wherein the cleaning unit is provided with grooves which serve to receive the tongues projecting from the underside of the squeegee head.

42. The hand-held implement according to claim 32, wherein the handle of the squeegee unit has an outer wall, wherein the handle of the cleaning unit is hollow and has an inner wall, and wherein the handle of the cleaning unit defines a plug-in opening arranged to receive the handle of the squeegee unit and to provide a frictionally locking connection between the outer side of the handle of the squeegee unit and the inner wall of the hollow handle of the cleaning unit.

43. The hand-held implement according to claim 42, wherein squeegee head has a frictional surface and wherein the hollow handle of the cleaning unit has a border, which encloses the plug-in opening of the handle of the cleaning unit and which has a frictional surface that coacts with the frictional surface of the squeegee head, when the handle of the squeegee unit is pushed into the hollow handle of the cleaning unit via the plug-in opening, such that a front length section of the outer side of the handle of the squeegee unit can be pressed in a frictionally locking manner against a front length section of the inner wall of the cleaning unit.

44. The hand-held implement according to claim 42, wherein the squeegee head has a rear, increasingly narrow nose projecting rearwardly and outwardly from the outer side of the handle of the squeegee unit, having an end surface that is rounded, and two guide surfaces, one on each side of the nose, of the squeegee head exhibits an end surface which, from its upper edge which is round in plan view, projects, in the form of a cylindrical cutout in the circumferential direction of the handle, rearwards with respect to the outer side of the handle and is bounded by guide surfaces, on the two longitudinal sides, and wherein the border of the plug-in opening of the hollow handle of the cleaning unit has an inwardly and rearwardly directed bevel conforming to the end and guide surfaces of the nose so as to align the cleaning and squeegee units when the handle of the squeegee unit is pushed into the hollow handle of the cleaning unit via the plug-in opening.

* * * * *

UNITED STATES PATENT AND TRADEMARK OFFICE

CERTIFICATE OF CORRECTION

PATENT NO. : 5,666,685

DATED : September 16, 1997

INVENTOR(S) : von Grolman et al.

It is certified that error appears in the above-indentified patent and that said Letters Patent is hereby corrected as shown below:

Col. 7, line 7, "hurling" should be --knurling--.

Col. 17, line 47, "revived" should be --received--.

Col. 18, line 38, between "hollow" and "defines" a comma should be inserted.

Signed and Sealed this

Twentieth Day of January, 1998

*Attest:*

BRUCE LEHMAN

*Attesting Officer*

*Commissioner of Patents and Trademarks*